US007384033B2

(12) United States Patent
Asada

(10) Patent No.: US 7,384,033 B2
(45) Date of Patent: Jun. 10, 2008

(54) FEED ROLLER UNIT AND CONVEYANCE APPARATUS

(75) Inventor: Tetsuo Asada, Kuwana (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 161 days.

(21) Appl. No.: 11/071,169

(22) Filed: Mar. 4, 2005

(65) Prior Publication Data

US 2005/0194733 A1 Sep. 8, 2005

(30) Foreign Application Priority Data

Mar. 5, 2004 (JP) ..... 2004-062532

(51) Int. Cl.
*B65H 3/06* (2006.01)

(52) U.S. Cl. ..... 271/114; 271/117; 271/113

(58) Field of Classification Search ..... 271/113, 271/114, 117, 118
See application file for complete search history.

(56) References Cited

U.S. PATENT DOCUMENTS 6,322,065 B1 * 11/2001 Underwood et al. ..... 271/117
6,503,010 B2 * 1/2003 Jeong ..... 400/629
2004/0012139 A1 * 1/2004 Asada et al. ..... 271/113

FOREIGN PATENT DOCUMENTS

| | | | |
|---|---|---|---|
| JP | 9-244110 | | 9/1997 |
| JP | 11-049388 | | 2/1999 |
| JP | 2000-053266 | | 2/2000 |
| JP | 2000-302258 | | 10/2000 |
| JP | 2002154667 A | * | 5/2002 |
| JP | 2003-81468 | | 3/2003 |
| JP | 2003-146454 | | 5/2003 |

OTHER PUBLICATIONS

JP Office Action dtd Oct. 2, 2007, JP Appln. 2004-062532.

* cited by examiner

*Primary Examiner*—Patrick Mackey
*Assistant Examiner*—Kaitlin S Joerger
(74) *Attorney, Agent, or Firm*—Banner & Witcoff, Ltd.

(57) ABSTRACT

A feed roller unit comprises: a feed roller that abuts against a topmost sheet of a stack of sheets, and rotates to convey the topmost sheet in a conveyance direction, the feed roller being provided to be displaceable in a direction reverse to the conveyance direction while rolling on the topmost sheet; a driving force transmission unit that transmits a driving force generated by a driving source to the feed roller to rotate the feed roller; and an urging unit that provides an urging force to the feed roller in a direction to suppress the displacement of the feed roller.

20 Claims, 16 Drawing Sheets

FEED ROLLER UNIT AND CONVEYANCE APPARATUS

BACKGROUND OF THE INVENTION

1. Field of the Invention

The present invention relates to a feed roller unit having a feed roller which can abut against a topmost sheet of a stack of sheets, and rotate to separate the top sheet from the other sheets and convey the top sheet in a specific conveyance direction, and conveyance apparatus having the feed roller unit.

2. Description of the Related Art

There has been heretofore considered a feed roller unit having a feed roller which can abut against a top sheet of a stack of sheets, and rotate to separate the top sheet from the other sheets and convey the top sheet in a specific conveyance direction, and a driving force transmission unit for transmitting a driving force generated by a driving source to the feed roller so as to rotate the feed roller. In such a feed roller unit, the driving force generated by the driving source is transmitted to the feed roller through the driving force transmission unit so as to rotate the feed roller. Thus, the sheets such as recording paper retained in a stacked state can be conveyed, for example, toward a printer engine or the like, sequentially from the top one of the sheets.

In addition, in such apparatus, it is necessary to prevent a so-called multi feed in which two or more sheets lying on top of each other are conveyed together. To this end, there have been proposed techniques in which the feed roller is made eccentric to change a pressing force applied to the sheets (for example, see JP-A-2000-302258), or two kinds of pressing forces can be switched in accordance with the thickness of the sheets (for example, see JP-A-2003-146454).

SUMMARY OF THE INVENTION

However, it has been proved that a large conveyance force is applied to the sheets the moment the feed roller begins to rotate. That is, the driving force generated by the driving source such as a motor is transmitted to the feed roller through the driving force transmission unit which is typically of a series of gears or the like. Just after the driving source begins to generate the driving force, friction or the like in the driving force transmission unit prevents the feed roller from rotating, and the driving force is accumulated in the driving force transmission unit. Then, the moment the feed roller begins to rotate, the driving force accumulated till then is released as a rotating force (that is, a conveyance force applied to the sheets) of the feed roller instantaneously. This may cause a multi feed.

In the related art, it is impossible to take measures against such a large conveyance force applied at the beginning of conveyance. The best measure to be taken is to increase the startup time of rotating the feed roller to thereby release the accumulated driving force gradually. However, when the startup time of rotating the feed roller is increased, the total conveyance rate of the sheets is lowered. Thus, in the case of a printer or the like, the lowered conveyance rate goes against the trend to increase the speed of image formation.

It is therefore one of objects of the present invention to provide a feed roller unit which can suppress a large conveyance force applied to sheets the moment a feed roller begins to rotate so that a multi feed of the sheets can be prevented reliably, and conveyance apparatus having the feed roller unit.

According to a first aspect of the invention, there is provided a feed roller unit including: a feed roller that abuts against a topmost sheet of a stack of sheets, and rotates to convey the topmost sheet in a conveyance direction, the feed roller being provided to be displaceable in a direction reverse to the conveyance direction while rolling on the topmost sheet; a driving force transmission unit that transmits a driving force generated by a driving source to the feed roller to rotate the feed roller; and an urging unit that provides an urging force to the feed roller in a direction to suppress the displacement of the feed roller.

According to a second aspect of the invention, there is provided a conveyance apparatus including: a tray that retains a stack of sheets; a feed roller that abuts against a topmost sheet of the stack of sheets in the tray, and rotates to convey the topmost sheet in a conveyance direction, the feed roller being provided to be displaceable in a direction reverse to the conveyance direction while rolling on the topmost sheet; a driving force transmission unit that transmits a driving force generated by a driving source to the feed roller to rotate the feed roller; and an urging unit that provides an urging force to the feed roller in a direction to suppress the displacement of the feed roller.

BRIEF DESCRIPTION OF THE DRAWINGS

These and other objects and advantages of the present invention will become more fully apparent from the following detailed description taken with the accompanying drawings, in which.

DETAILED DESCRIPTION OF THE PREFERRED EMBODIMENTS

A preferred embodiment of the invention will be described below with reference to the accompanying drawings. The following description will be made using so-called inclined-feed type paper feed apparatus 10 (corresponding to conveyance apparatus according to the invention) in which a loading plate 11*a* (see FIG. 2) serving as a tray is disposed with a slope, by way of example. Needless to say, the invention can be also applied to so-called bottom-feed type paper feed apparatus in which a tray is disposed horizontally.

Figure 1:
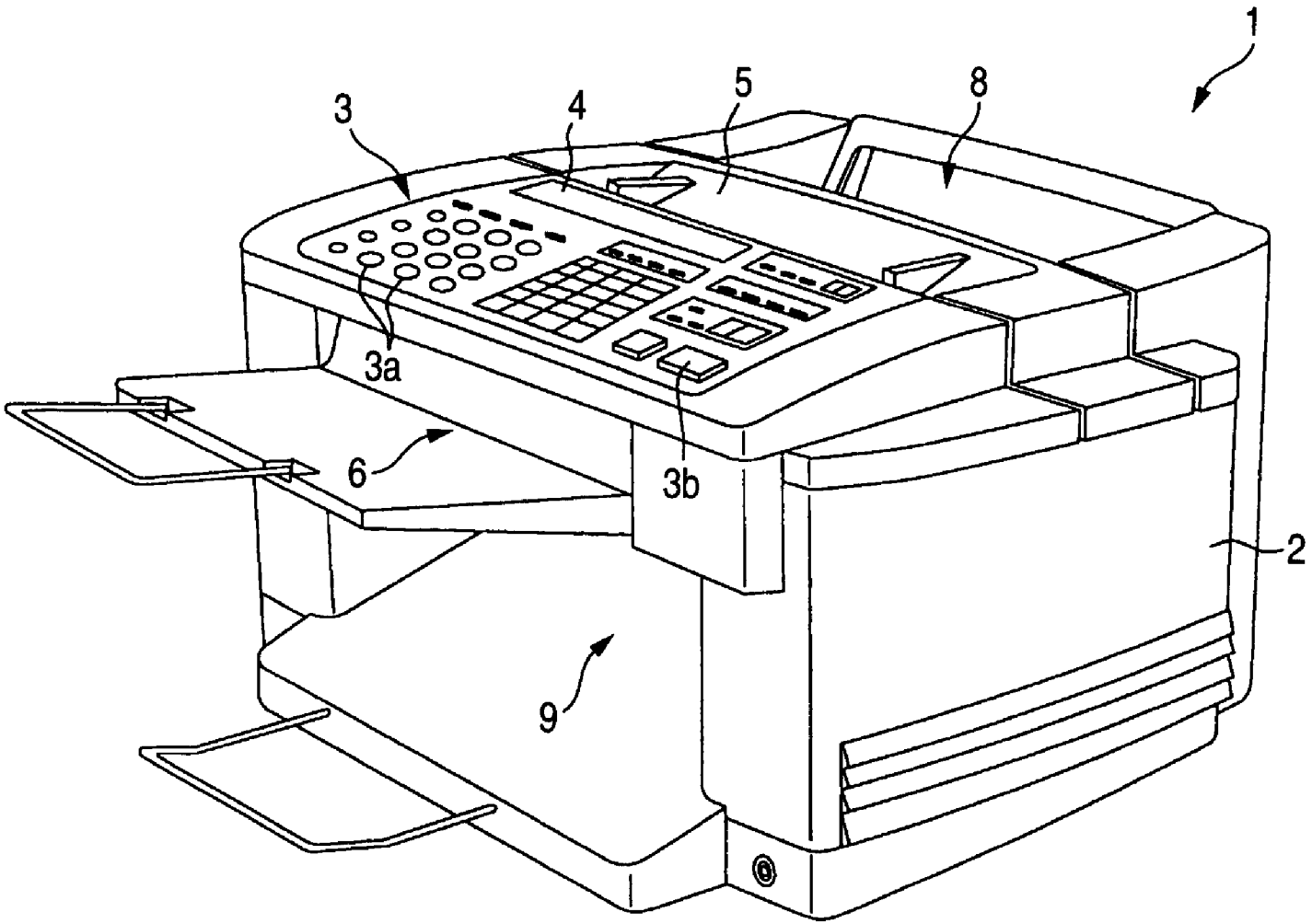
FIG. 1 is a perspective view of the external appearance of multifunctional peripheral apparatus mounted with paper feed apparatus to which the invention is applied.

FIG. 1 is a perspective view of the external appearance of multifunctional peripheral apparatus 1 mounted with the paper feed apparatus 10 (see FIG. 2) according to an embodiment of the invention. The multifunctional peripheral apparatus 1 has various functions such as a facsimile function, a printer function, a scanner function, a copying function and a video function.

As shown in FIG. 1, the multifunction peripheral apparatus 1 has an apparatus body 2 formed into a substantially box-like body. An operation panel 3 is disposed in the top surface portion of the apparatus body 2. The operation panel 3 is provided with various buttons such as numerical buttons 3*a* from "0" to "9", a start button 3*b*, etc. Various operations are performed by pushing down these buttons. A liquid crystal display (LCD) 4 is provided at the rear of the operation panel 3. Setting conditions of the multifunctional peripheral apparatus 1, various operation messages, etc. are displayed on the LCD 4 in accordance with necessity.

A document loading portion 5 on which a stack of original documents to be facsimiled to a destination facsimile machine at the time of the facsimile function or a stack of original documents to be copied at the time of the copying function can be loaded is provided at the rear of the LCD 4. Various original documents loaded on the document loading portion 5 are conveyed to the inside of the apparatus body 2, and images formed on the surfaces of the original documents are read by a scanner (not shown). The original documents from which the images have been read are further conveyed and ejected to a document ejection portion 6 provided under the operation panel 3.

A recording paper insertion portion 8 is provided at the rear of the document loading portion 5. The recording paper insertion portion 8 is a space to which a plurality of sheets of recording paper (sheet) P are inserted in a stacked state. The recording paper P inserted into the recording paper insertion portion 8 is conveyed into the apparatus body 2 by the paper feed apparatus 10 which will be described later. After images are printed on the recording paper P by a printer engine (not shown), the recording paper P is ejected from a recording paper ejection portion 9 provided under the document ejection portion 6.

Figure 2:
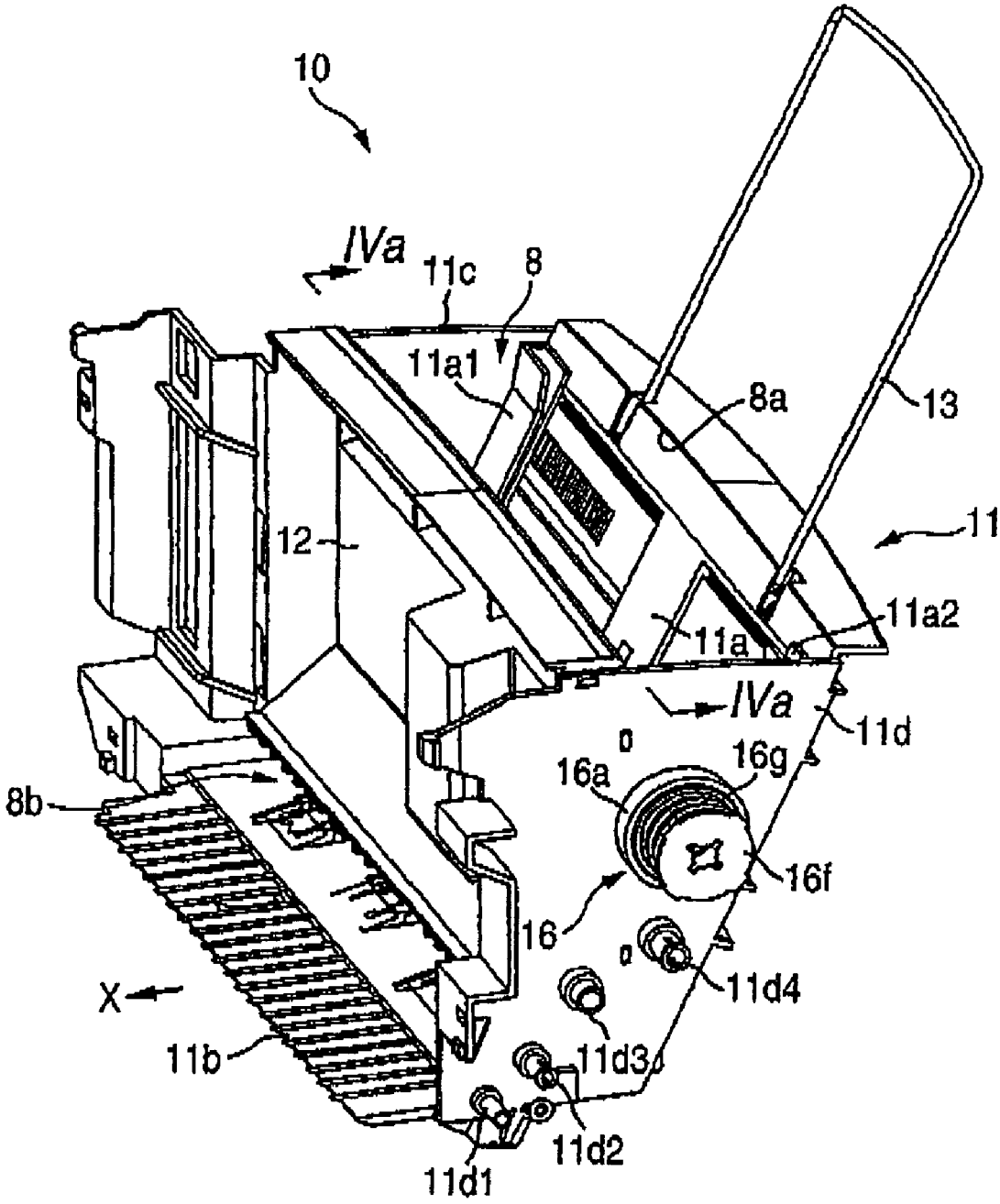
FIG. 2 is a perspective view of the external appearance of the paper feed apparatus to be mounted on the multifunctional peripheral apparatus.

FIG. 2 is a perspective view of the external appearance of the paper feed apparatus 10 to be mounted on the multifunctional peripheral apparatus 1. The arrow X in FIG. 2 designates the conveyance direction of the recording paper P. In FIG. 2, connecting gears 17-21 (see FIG. 3) for transmitting torque of a driving motor (not shown) as a driving source to a transmission gear 16*a* of a transmission unit 16 are not shown.

As shown in FIG. 2, the paper feed apparatus 10 has an insertion portion frame 11 received in the apparatus body 2, and an insertion portion cover 12. By these members 11 and 12, the aforementioned recording paper insertion portion 8 is formed as a space to which the recording paper P can be inserted. The insertion portion frame 11 chiefly has a loading plate 11*a*, a guide plate 11*b* and a pair of side wall plates 11*c* and 11*d*. These members 11*a*-11*d* are formed integrally out of resin or the like. The loading plate 11*a* serves to support the recording paper P inserted to the recording paper insertion portion 8. The loading plate 11*a* is formed so that the loading plate 11*a* can be loaded with a stack of sheets of the recording paper P.

The loading plate 11*a* is provided in a rear portion (right in FIG. 2) of the insertion portion frame 11. In the upper end of the loading plate 11*a*, a recording paper support member 13 is provided to extend further upward from the loading plate 11*a*. The recording paper support member 13 is made of a substantially U-shaped bar. When the paper length of the recording paper P is large, the recording paper support member 13 retains an upper portion of the recording paper P inserted to the recording paper insertion portion 8, so that the upper portion of the recording paper P can be prevented from hanging.

The loading plate 11*a* is sloped downward from the rear upper side (right upper side in FIG. 2) of the insertion portion frame 11 toward the front lower side (left lower side in FIG. 2) of the same. A separation slope 11*f* (see FIG. 5) which will be described later is connected to the lower end of the loading plate 11*a*. One end (right side in FIG. 2) of the guide plate 11*b* is connected to the front end of the separation slope 11*f*. The guide plate 11*b* serves to guide the recording paper P loaded on the loading plate 11*a* toward the printer engine (not shown). The guide plate 11*b* is provided to extend substantially horizontally from the connection portion (right side in FIG. 2) where the guide plate 11*b* is connected to the separation slope 11*f* to the side (left side in FIG. 2) where the printer engine (not shown) is disposed. Thus, the recording paper P loaded on the loading plate 11*a* is guided substantially horizontally to the printer engine along the upper surface of the guide plate 11*b*. In addition, the pair of side wall plates 11*c* and 11*d* are provided erectly in the width-direction opposite ends of the loading plate 11*a* and the guide plate 11*b*.

The paired side wall plates 11*c* and 11*d* are opposed through a predetermined distance. On the loading plate 11*a*, recording paper guides 11*a*1 and 11*a*2 are disposed closely to the side wall plates 11*c* and 11*d* respectively. The recording paper guides 11*a*1 and 11*a*2 are connected through a rack (not shown) and a pinion (not shown) provided on the insertion portion frame 11. The recording paper guides 11*a*1 and 11*a*2 are designed to engage with the rack and the pinion so that the recording paper guides 11*a*1 and 11*a*2 can move in the width direction of the loading plate 11*a* in accordance with the paper width of the recording paper P. Thus, the recording paper P is loaded on the loading plate 11*a* so as to be inserted and fitted between the paired recording paper guides 11*a*1 and 11*a*2. In addition, the insertion portion cover 12 is retained between the opposed surfaces of the paired side wall plates 11*c* and 11*d*, so as to have a predetermined distance from the loading plate 11*a*. The width-direction opposite ends of the insertion portion cover 12 are attached to the side wall plates 11*c* and 11*d* respectively.

The aforementioned recording paper insertion portion 8 is provided in the space surrounded by the members 11*a*-11*d* of the insertion portion frame 11 and the insertion portion cover 12. The recording paper insertion portion 8 is provided with a paper feed hole 8*a* to which the recording paper P can be inserted. In addition, a gap having a predetermined width is provided between the insertion portion cover 12 and the guide plate 11*b*. An ejection hole 8*b* for ejecting the recording paper P from the recording paper insertion portion 8 is provided in this gap portion. The ejection hole 8*b* is formed to communicate with the inside of the recording paper insertion portion 8 so that the recording paper P inserted to the recording paper insertion portion 8 can pass through the ejection hole 8*b*.

The transmission unit 16 is disposed on the surface (near side in FIG. 2) of the side wall plate 11*d* which surface is not opposed to the side wall plate 11*c*. The transmission unit 16 serves to transmit torque to a driving shaft 15 which will be described later. In a portion under the transmission unit 16, substantially cylindrical shaft portions 11*d*1-11*d*4 are provided to project from the surface (near side in FIG. 2) of the side wall plate 11*d* which surface is not opposed to the side wall plate 11*c*. The shaft portions 11*d*1-11*d*4 serve to pivotally support the connecting gears 17-21 which will be described below. The shaft portions 11*d*1-11*d*4 project to form substantially one line from the lower end side of the side wall plate 11*d* to the transmission unit 16 side.

Figure 3:
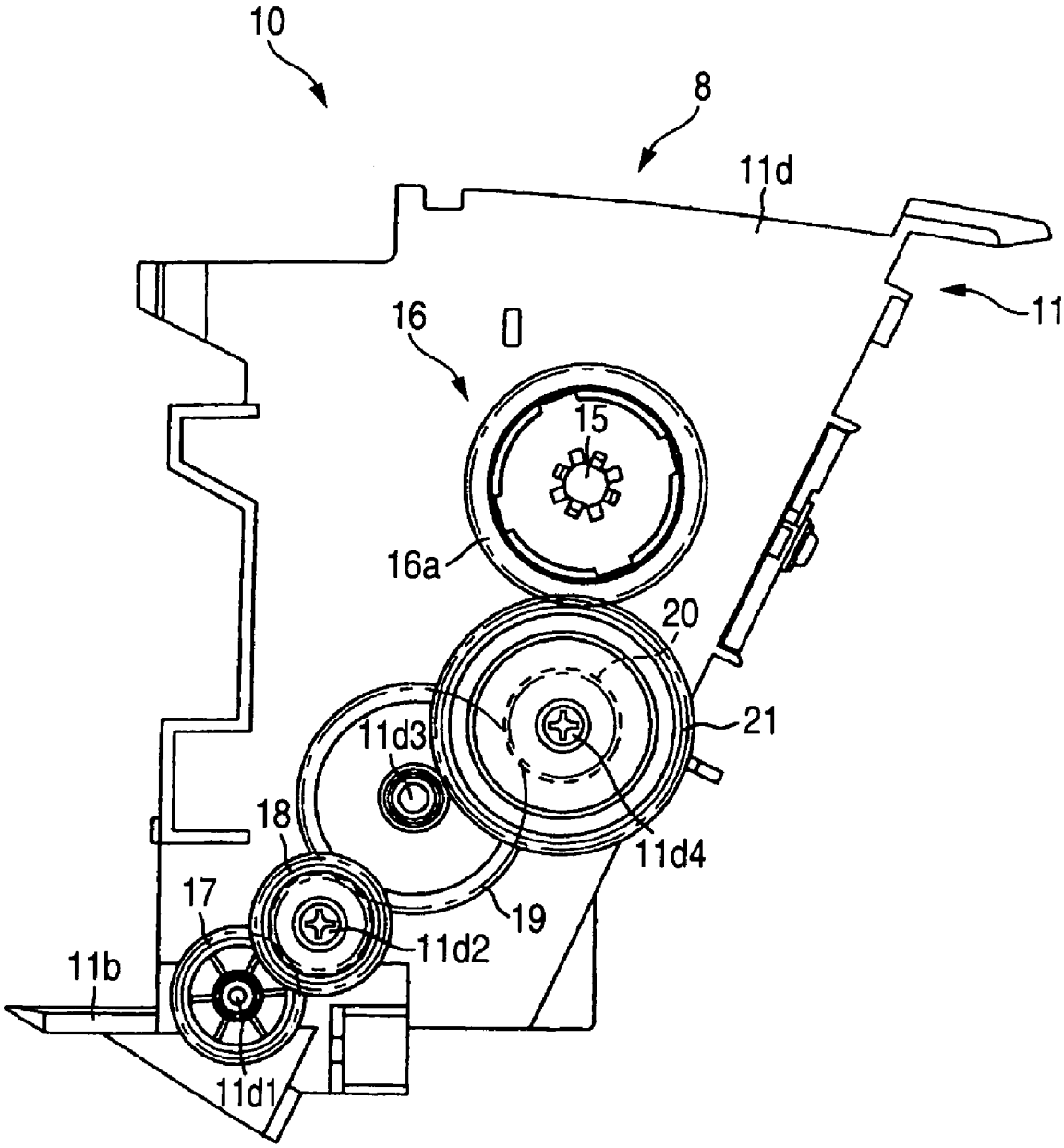
FIG. 3 is a side view of the paper feed apparatus.

FIG. 3 is a side view of the paper feed apparatus 10. In FIG. 3, pitch circles of the connecting gears 17-21 are illustrated by the chain lines. The gear teeth cut in the outer circumferences of the connecting gears 17-21 are not shown. As shown in FIG. 3, the five connecting gears 17-21 formed like spur gears out of resin or the like are supported rotatably on the shaft portions 11*d*1-11*d*4 projecting from the side wall plate 11*d*, respectively. The connecting gear 17 is pivotally supported on the shaft portion 11*d*1. The connecting gear 17 is formed to engage with a pinion gear (not shown) attached to the rotating shaft of the driving motor.

The connecting gear 18 pivotally supported on the shaft portion 11*d*2 engages with the connecting gear 17. The connecting gear 19 pivotally supported on the shaft portion 11*d*3 engages with the connecting gear 18. The connecting gear 20 pivotally supported on the shaft portion 11*d*4 engages with the connecting gear 19. The connecting gear 21 concentrically with the connecting gear 20 is formed integrally therewith. The connecting gear 21 is pivotally supported on the shaft portion 11*d*4 together with the connecting gear 20. The connecting gear 21 engages with the transmission gear 16*a* of the transmission unit 16.

The rotation of the rotating shaft of the driving motor is transmitted to the transmission gear 16*a* through the pinion gear and the connecting gears 17-21. That is, when the rotating shaft of the driving motor is rotated, the rotation of the rotating shaft is transmitted to the pinion gear and the connecting gears 17-21 in turn. Thus, the pinion gear and the connecting gears 17-21 are rotated. The rotation transmitted to the connecting gear 21 is transmitted to the transmission gear 16*a* engaging with the connecting gear 21. Further, the rotation transmitted to the transmission gear 16*a* is transmitted to the driving shaft 15 through the transmission unit 16. As a result, the driving shaft 15 is rotated.

The driving shaft 15 is supported at the opposite end portions thereof rotatably by the side wall plates 11*c* and 11*d*. The driving shaft 15 is a rotating shaft by which the rotation of the driving motor transmitted through the transmission unit 16 is transmitted to a paper feed roller unit 31 which will be described later. In addition, the driving shaft 15 is placed in parallel to the loading plate 11*a* and at a distance therefrom (see FIG. 5). The recording paper P is inserted and fitted between the driving shaft 15 and the loading plate 11*a*.

The transmission unit 16 is disposed on the end portion of the driving shaft 15 on the side wall plate 11*d* side. The transmission unit 16 serves to transmit the driving force generated by the driving motor to the driving shaft 15. The transmission unit 16 chiefly has the transmission gear 16*a*, transmission plates 16*b* and 16*c*, a spring retention plate 16*f* and a compression spring member 16*g* (see FIGS. 4A-4B). Here, with reference to FIGS. 4A-4B, description will be made about the details of the transmission unit 16.

Figure 4B:
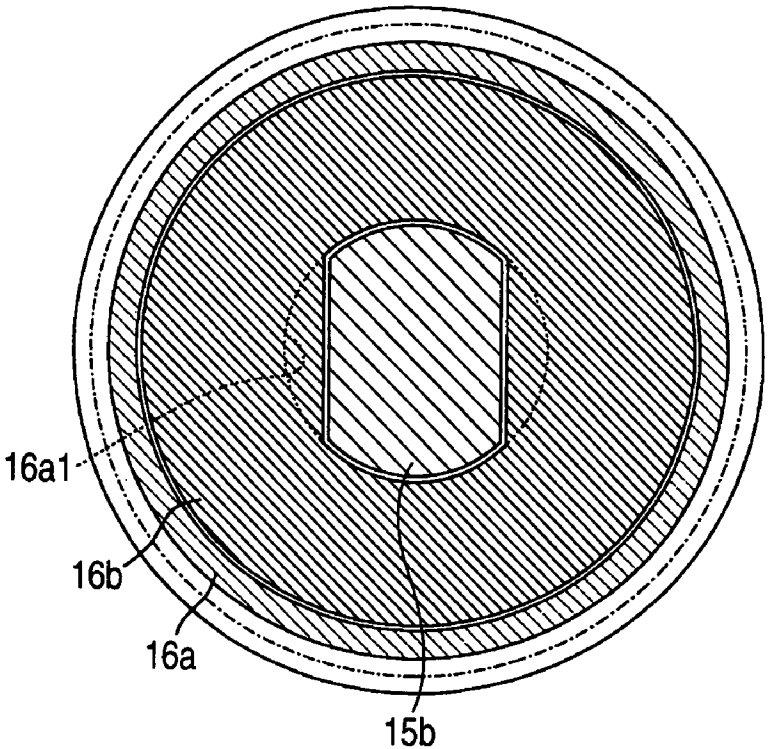
FIG. 4B is a sectional view taken on line IVb-IVb in FIG. 4A.
Figure 4A:
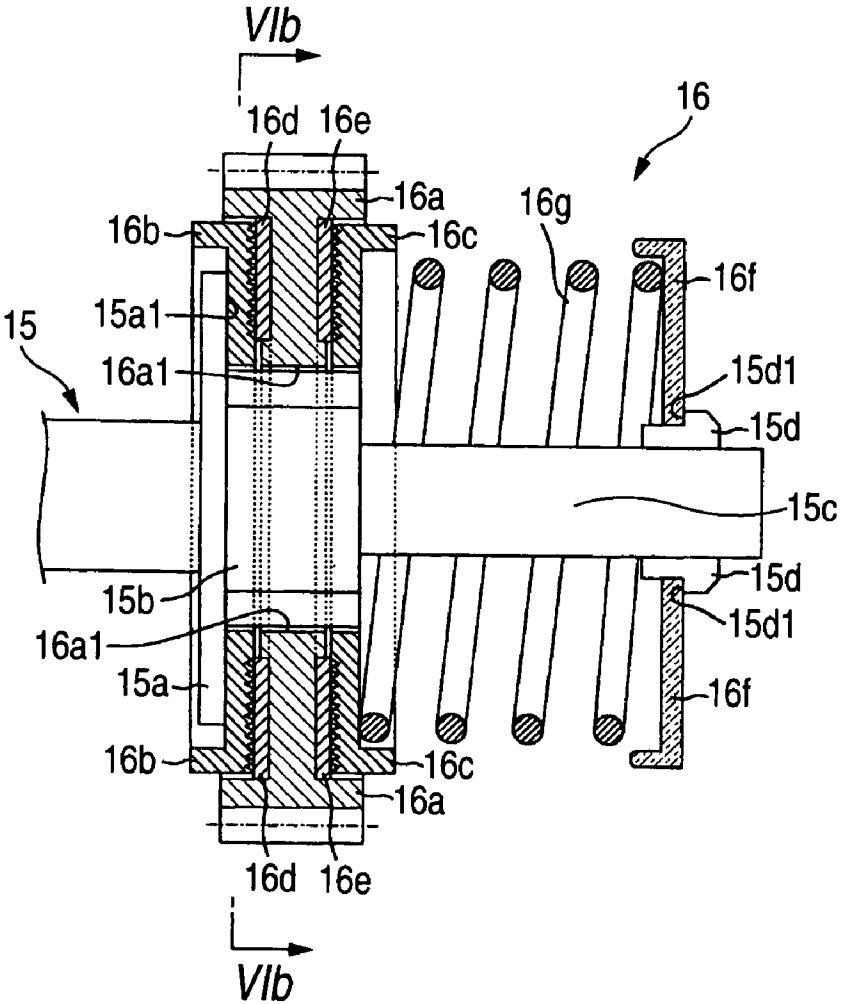
FIG. 4A is a sectional view of a transmission unit 16.

FIG. 4A is a sectional view of the transmission unit 16 taken on line IVa-IVa in FIG. 2. FIG. 4B is a sectional view taken on line IVb-IVb in FIG. 4A. As shown in FIG. 4A, a flange 15*a*, a boss 15*b*, a spring retention portion 15*c* and a stopper portion 15*d* are formed integrally in one end portion (right side in FIG. 4A) of the driving shaft 15.

The flange 15*a* is formed into a substantially disc-like shape concentrically with the axis of the driving shaft 15. A flange stopper surface 15*a*1 is formed in one side surface (right side in FIG. 4A) of the flange 15*a*. The boss 15*b* extends from the flange stopper surface 15*a*1. The circumferential opposite side surfaces of the boss 15*b* are notched flatly and substantially in parallel as shown in FIG. 4B. Thus, the sectional shape of the boss 15*b* is formed into a substantially compressed circular shape.

In addition, as shown in FIG. 4A, the spring retention portion 15*c* having a substantially columnar shape extends from the end surface of the boss 15*b* opposite to the flange 15*a*. The stopper portion 15*d* is provided in the end portion of the spring retention portion 15*c* opposite to the boss 15*b* so as to project on the outer circumferential side. A stopper surface 15*d*1 is formed in a portion of the stopper portion 15*d* opposed to the boss 15*b*.

The transmission gear 16*a* of the transmission unit 16 is a spur gear formed out of resin or the like. The boss 15*b* of the driving shaft 15 is rotatably included in the inner circumference of the transmission gear 16*a*. Friction sheets 16*d* and 16*e* formed out of non-woven fabric are circumferentially attached to the opposite left and right side surfaces of the transmission gear 16*a*. Each friction sheet 16*d*, 16*e* has a substantially annular sheet-like shape. The transmission plates 16*b* and 16*c* formed out of resin or the like are disposed on the left and right opposite sides of the transmission gear 16*a*. Each transmission plate 16*b*, 16*c* has a substantially annular plate-like shape. The boss 15*b* of the driving shaft 15 is fitted to the inner circumferences of the transmission plates 16*b* and 16*c*.

As shown in FIG. 4B, the inner circumference of each transmission plate 16*b*, 16*c* is formed into a substantially compressed circular shape fitted to the outer circumferential shape of the boss 15*b* of the driving shaft 15. When the inner circumferential shapes of the transmission plates 16*b* and 16*c* are fitted thus to the outer circumferential shape of the boss 15*b*, the transmissionplates 16*b* and 16*c* can be rotated integrally with the driving shaft 15. On the other hand, the transmission gear 16*a* is formed into a circular shape in which the inner diameter of the inner circumference 16*a*1 thereof is slightly larger than the outer diameter of the boss 15*b*. Thus, the transmission gear 16*a* can run idle with respect to the boss 15*b* of the driving shaft 15.

As shown in FIG. 4A, the spring retention plate 16*f* and the compression spring member 16*g* are disposed in the transmission plate 16*c* on the opposite side to the transmission gear 16*a*. The spring retention plate 16*f* serves to retain the compression spring member 16*g* in cooperation with the transmission plate 16*c*. In addition, the spring retention plate 16*f* is engaged with the stopper portion 15*d* provided to project on the spring retention portion 15*c* of the driving shaft 15. Thus, the movement of the spring retention plate 16*f* in the reverse direction (right side in FIG. 4A) to the transmission plate 16*c* is limited by the stopper surface 15*d*1 of the stopper portion 15*d*.

The compression spring member 16*g* is disposed between the transmission plate 16*c* and the spring retention plate 16*f* in the state where the compression spring member 16*g* is elastically compressed and deformed. The spring retention portion 15*c* of the driving shaft 15 is inserted through the inner circumference of the compression spring member 16*g*. Accordingly, due to the urging force of the compression spring member 16*g*, the friction sheets 16*d* and 16*e* are brought into pressure contact with the transmission plates 16*b* and 16*c* respectively. Thus, by the pressure contact, a frictional force can be applied between the contact surfaces of each friction sheet 16*d*, 16*e* and each transmission plate 16*b*, 16*c*.

Accordingly, when the torque transmitted to the transmission gear 16*a* is smaller than the frictional force generated between the contact surfaces of the friction sheets 16*d* and 16*e* and the transmission plates 16*b* and 16*c*, the transmission plates 16*b* and 16*c* rotate integrally with the transmission gear 16*a* through the frictional force, and further the driving shaft 15 rotates integrally with the transmission plates 16*b* and 16*c*. On the other hand, when the torque transmitted to the transmission gear 16*a* is larger than the frictional force generated between the contact surfaces of the friction sheets 16*d* and 16*e* and the transmission plates 16*b* and 16*c*, the transmission gear 16*a* runs idle with respect to the driving shaft 15. The torque transmitted to the driving shaft 15 is limited by the idle running.

Figure 5:
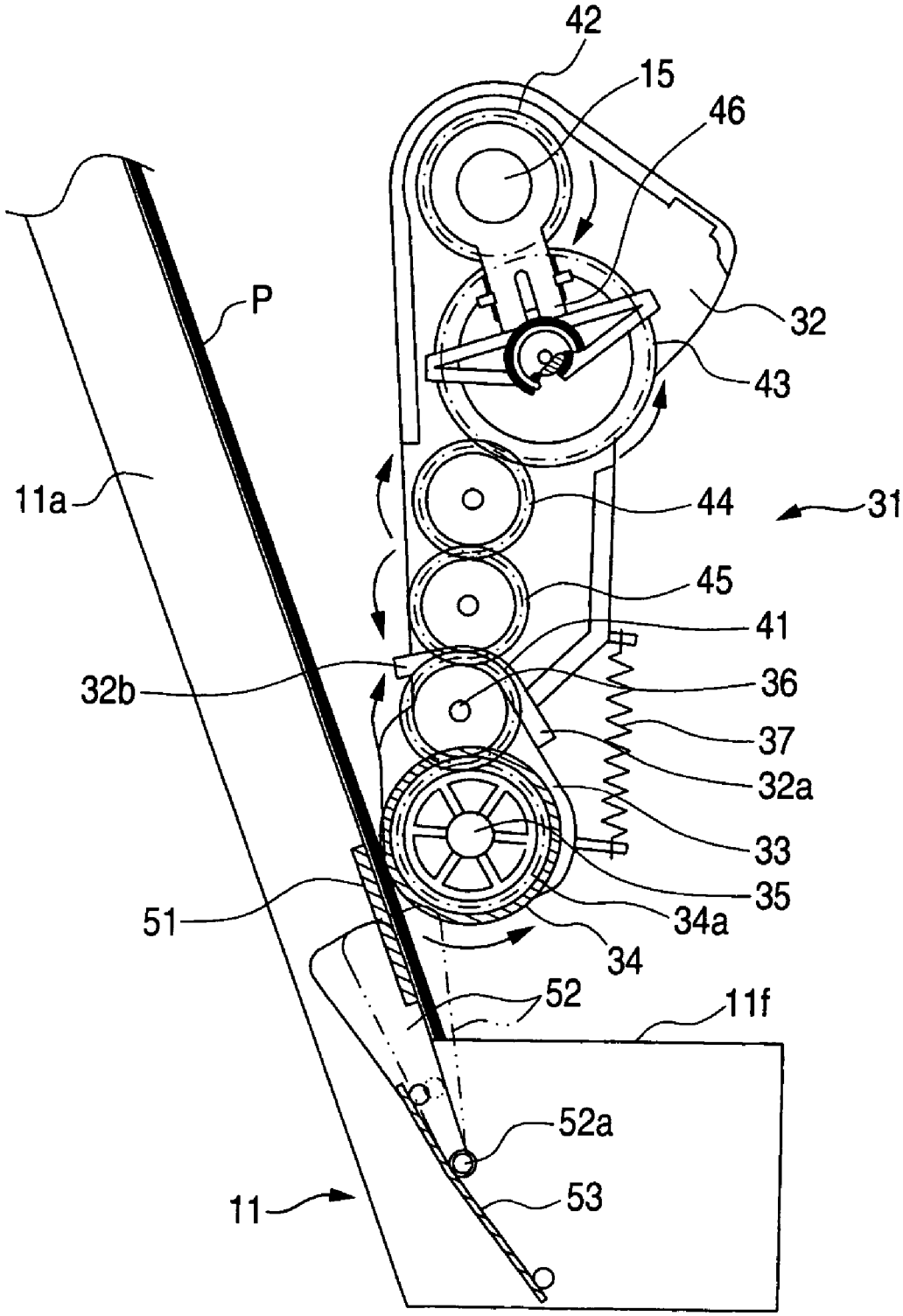
FIG. 5 is a view of a longitudinal center section of a paper feed roller unit of the paper feed apparatus.

The paper feed roller unit 31 is pivotally supported on the axially substantial center portion of the driving shaft 15. The paper feed roller unit 31 serves to convey the recording paper P mounted on the loading plate 11*a* toward the guide plate 11*b*. The paper feed roller unit 31 has a holder member 32 disposed in the axially substantial center of the driving shaft 15, a support member 33 swingably connected to the holder member 32, and a paper feed roller 34, as follows. FIG. 5 is a view of a longitudinal center section showing the configuration of the paper feed roller unit 31. Incidentally, FIG. 5 is a view of a central section of the paper feed roller unit 31 observed from the opposite side to FIG. 3.

The holder member 32 is swingably provided on the driving shaft 15, and urged clockwise by a not-shown torsion spring provided coaxially with the driving shaft 15. The support member 33 rotatably supports the paper feed roller 34 through a rotating shaft 35. The support member 33 is swingably connected to the holder member 32 through a swinging shaft 36. In addition, stopper portions 32*a* and 32*b* for limiting the swinging of the support member 33 are formed in the holder member 32, and a tension spring 37 is disposed on the front end side of the holder member 32 and the support member 33.

As a result, when no external force is applied, the support member 33 swings counterclockwise due to the operation of the tension spring 37 so as to abut against the stopper portion 32*a* on the front end side. Thus, the driving shaft 15, the swinging shaft 36 and the rotating shaft 35 are disposed substantially in a straight line. That is, when no external force is applied, the paper feed roller unit 31 is kept in the most extended state. The driving shaft 15, the swinging shaft 36 and the rotating shaft 35 are disposed in parallel to one another so that the paper feed roller 34 can abut against the recording paper P reliably irrespective of swinging of the holder member 32 or swinging of the support member 33.

Further, a gear 41 is rotatably supported on the swinging shaft 36. A gear 34*a* formed concentrically with the paper feed roller 34 engages with the gear 41. The aforementioned torque transmitted to the driving shaft 15 is transmitted to the gear 41 through gears 42-45 which will be described below. Further through the gear 34*a*, the transmitted torque rotates the paper feed roller 34 in the paper feed direction (counterclockwise) Each gear 34*a*, 41-45 is a spur gear.

The sun gear 42 is fixed to the driving shaft 15 concentrically therewith. Thus, the sun gear 42 rotates integrally with the driving shaft 15. The planet gear 43 is rotatably supported on an arm 46 swingably connected to the driving shaft 15. The planet gear 43 always engages with the sun gear 42. When the sun gear 42 rotates clockwise, the arm 46 and the planet gear 43 also swing clockwise in accordance with the rotation of the sun gear 42. The gear 44 is provided in the position where the gear 44 will engage with the planet 43 when the arm 46 and the planet gear 43 swing clockwise thus. The rotation of the gear 44 is transmitted to the aforementioned gear 41 through the gear 45.

On the surface of the loading plate 11*a*, a cork pad 51 is provided in a position where the cork pad 51 faces the paper feed roller 34. A slit (not shown) is provided in the center of the cork pad 51. A lock lever 52 which can project from and sink into the slit is swingably provided around a swinging shaft 52*a* provided near the lower end of the insertion portion frame 11. Further, a torsion spring 53 for urging the lock lever 52 in the direction in which the lock lever 52 projects is attached to the swinging shaft 52*a*. The urging force of the torsion spring 53 is low enough for the lock lever 52 not to project when at least one sheet of the recording paper P remains on the cork pad 51.

Figure 6:
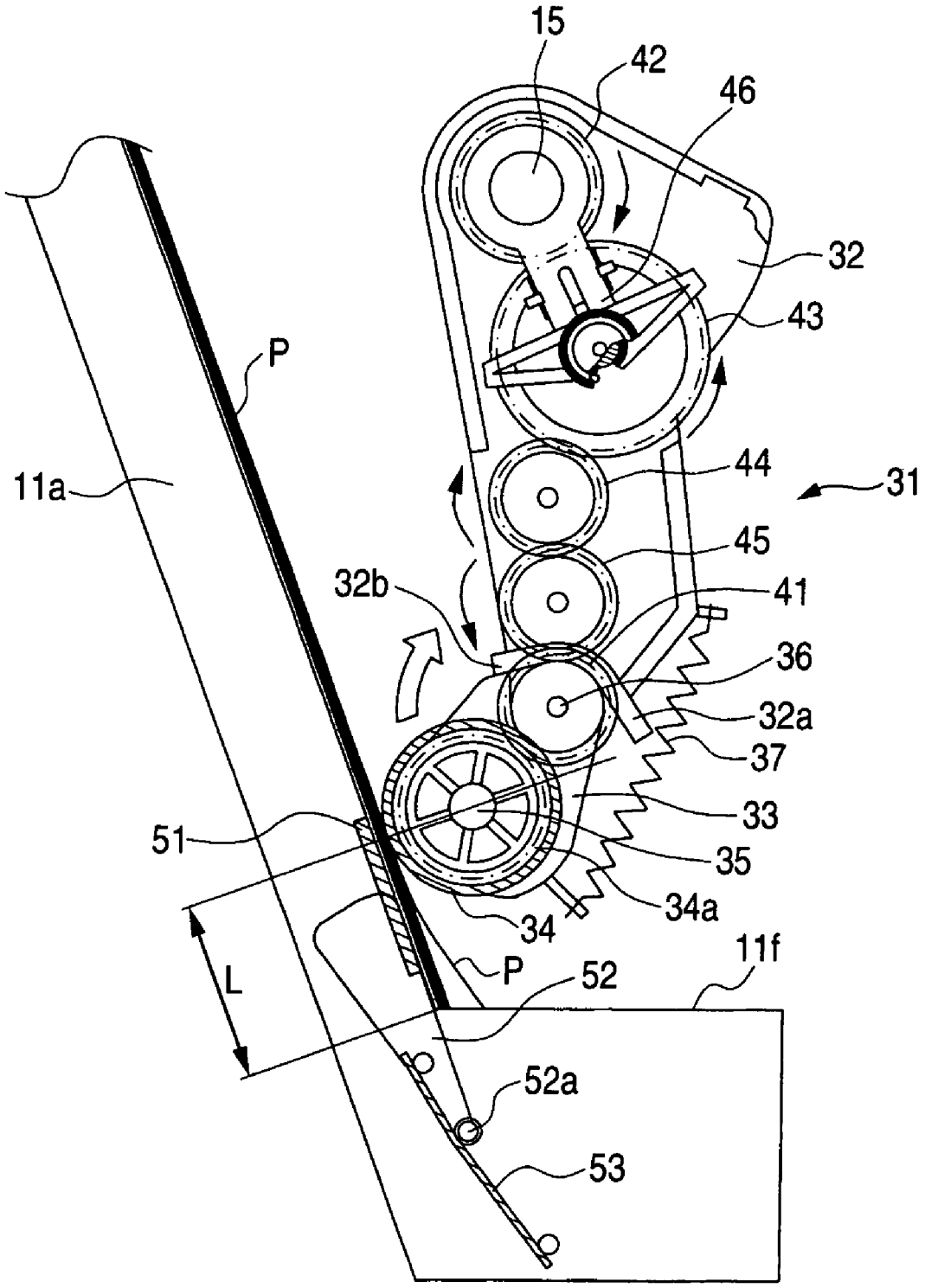
FIG. 6 is an explanatory view showing the operation of the paper feed roller unit.

Next, description will be made about the operation of the paper feed roller unit 31 configured thus. For feeding the paper, the sun gear rotates clockwise. Due to this rotation, the planet gear 43 gears with the gear 44 so that torque for rotating the paper feed roller 34 in the paper feed direction is transmitted to the paper feed roller 34 through the gears 45, 41 and 34*a*. Immediately after driving the paper feed roller 34, the support member 33 swings clockwise against the urging force of the tension spring 37 with respect to the holder member 32 due to the force with which the paper feed roller 34 is displaced while rolling on the recording paper P reversely with respect to the paper feed direction, and the force generated by the engagement between the gears 41 and 45, as shown in FIG. 6.

In such a manner, the support member 33 stops swinging as soon as the force with which the paper feed roller 34 is to be displaced on the recording paper P is balanced with the urging force of the tension spring 37 or as soon as the support member 33 abuts against the stopper portion 32*b*. After that, the recording paper P is conveyed by the rotation of the paper feed roller 34.

As described above, the paper feed roller 34 is provided to be displaced in a direction reverse to the conveyance direction of the recording paper P while rolling on the topmost recording paper P.

In the paper feed apparatus 10 provided with the separation slope 11*f*, the edge of the recording paper P is pressed on the separation slope 11*f* so that the top sheet of the recording paper P is bent between the paper feed roller 34 and the separation slope 11*f*. Thus, sheets of the recording paper P can be separated and conveyed one by one. To this end, as shown in FIG. 6, the distance L between the rotation shaft 35 and the connecting portion of the loading plate 11*a* and the separation slope 11*f* at the beginning of the conveyance of the recording paper P becomes longer as the recording paper P are firmer. That is, the distance L between the paper feed roller 34 and the separation slope 11*f* can be adjusted to an optimum value in accordance with the firmness of the recording paper P without using any sensor or the like.

Figure 7:
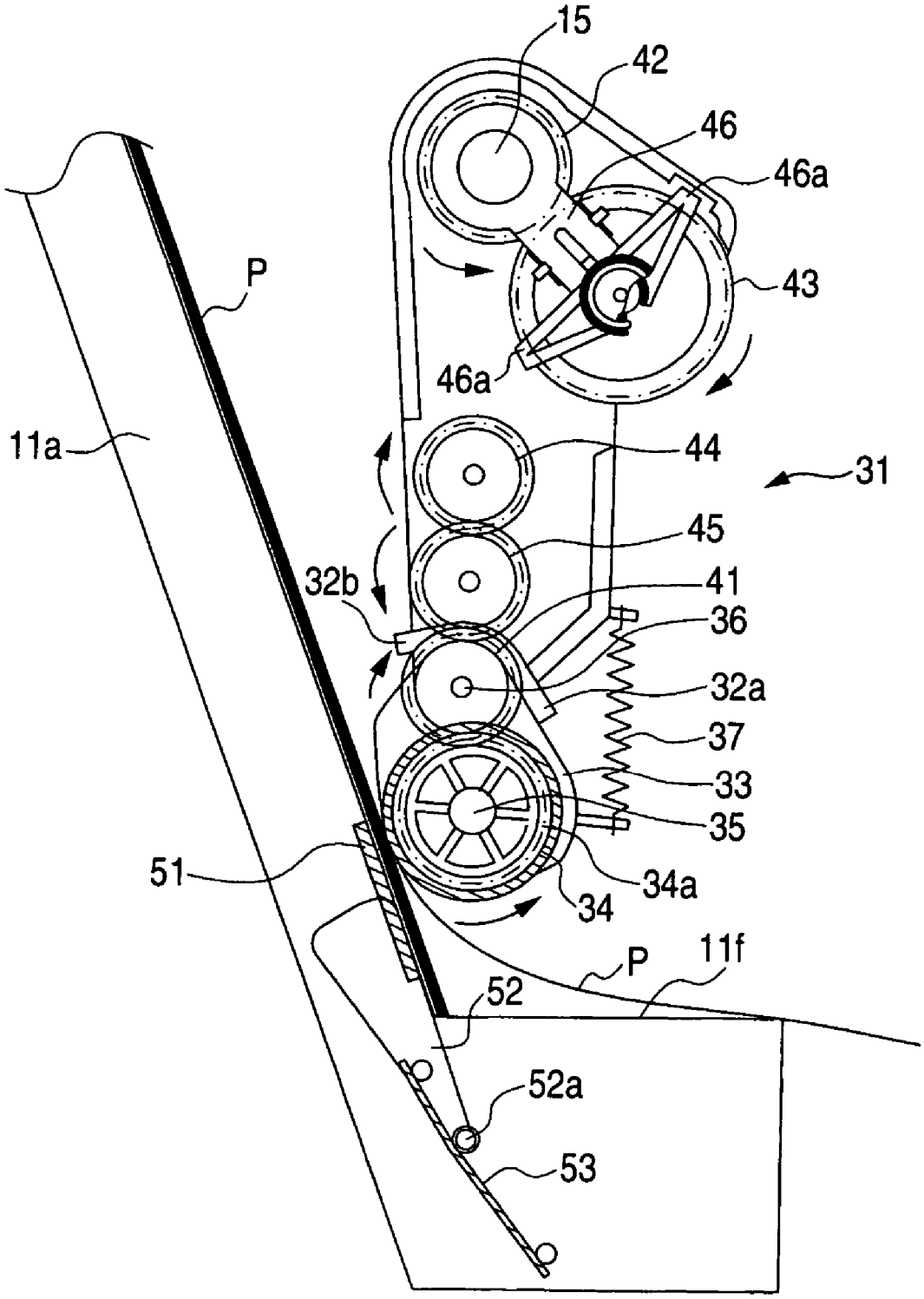
FIG. 7 is an explanatory view showing the operation of the paper feed roller unit following FIG. 6.

Next, when the recording paper P is conveyed by the printer engine included in the apparatus body 2 (see FIG. 1), control is made to rotate the driving shaft 15 reversely (counterclockwise). Then, as shown in FIG. 7, the arm 46 and the planet gear 43 swing counterclockwise so as to release the engagement between the planet gear 43 and the gear 44. Thus, the mechanisms ranging from the gear 44 to the paper feed roller 34 can rotate freely. As the recording paper P is conveyed by the printer engine, the paper feed roller 34 is rotated due to its own weight and an initial load applied to the paper feed roller 34 and the recording paper P. In the arm 46, stoppers 46*a* and 46*a* are formed on the opposite sides in the swinging direction. The aforementioned counterclockwise swinging of the arm 46 is stopped by abutment of the stopper 46*a* against the inner wall surface of the holder member 32.

In such a manner, the paper feed apparatus 10 repeats forward rotation and reverse rotation of the driving shaft 15 alternately so as to separate sheets of the recording paper P and feed them one by one. When feeding all the sheets of the recording paper P is completed, the paper feed roller 34 comes in direct contact with the cork pad 51. When the driving shaft 15 is rotated forward in this state, the frictional coefficient of the surface of the cork pad 51 is so large that the paper feed roller 34 is displaced while rolling on the cork pad 51 reversely with respect to the paper feed direction, and passes over the cork pad 51 perfectly. In addition, the frictional coefficient of the surface of the loading plate 11*a* is so small that the paper feed roller 34 cannot be displaced to further slide on the loading plate 11*a*.

Figure 8:
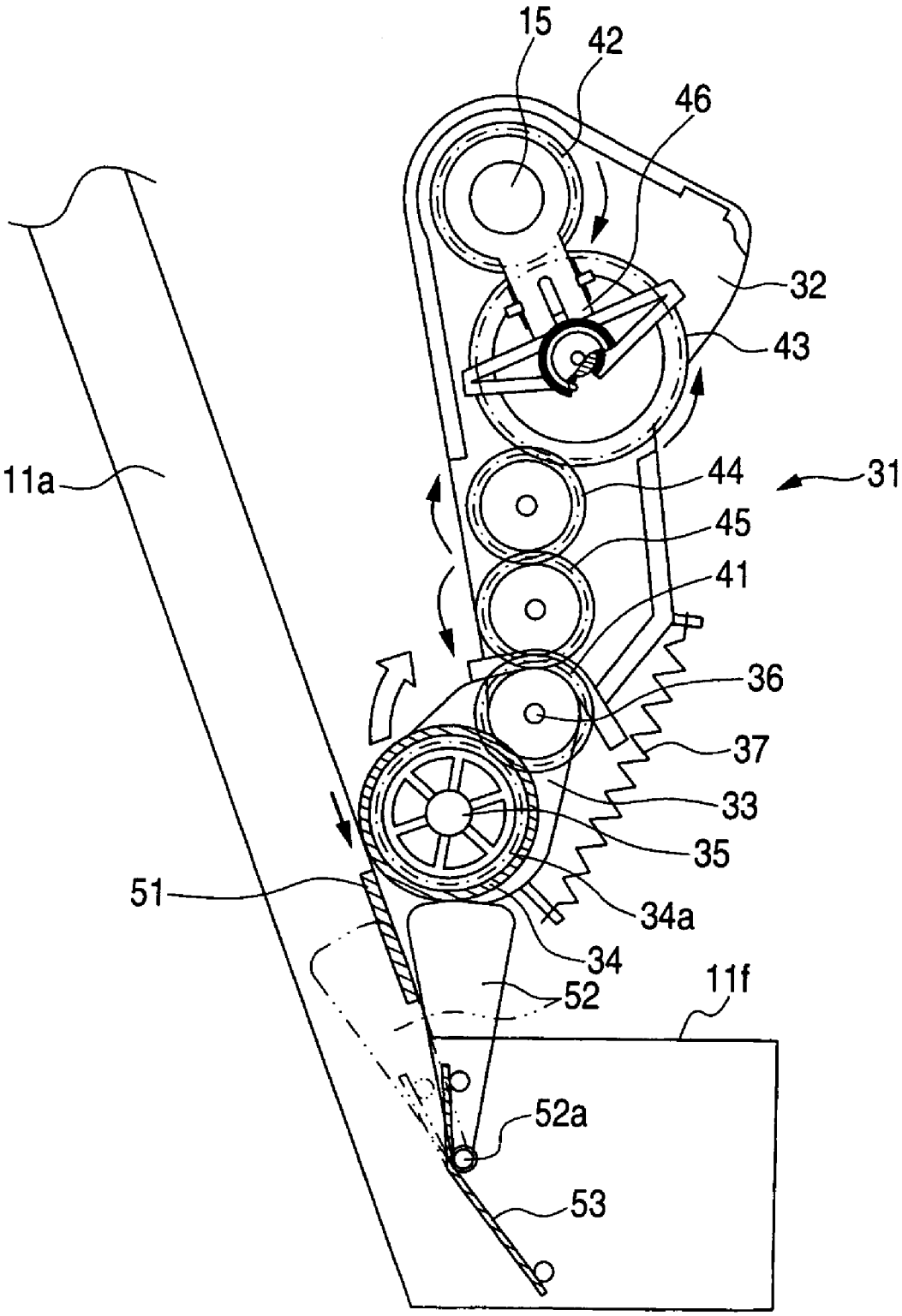
FIG. 8 is an explanatory view showing the operation of the paper feed roller unit further following FIG. 7.

When the paper feed roller 34 is displaced to such a position, nothing exists on the lock lever 52, as shown in FIG. 8. Thus, the lock lever 52 projects due to the urging force of the torsion spring 53. Then, the lower end of the support member 33 and the upper end of the lock lever 52 abut against each other so that the paper feed roller 34 is prevented from returning onto the cork pad 51. Accordingly, even when the paper feed roller 34 is continuously driven after that, the paper feed roller 34 can be prevented from making periodic noise due to its abutment against the cork pad 51 repeatedly, or from being worn down due to its rubbing against the cork pad 51.

In such a manner, according to this embodiment, the paper feed roller 34 is displaced while rolling on the recording paper P the moment the paper feed roller 34 begins to rotate. As soon as the force with which the paper feed roller 34 is to be displaced is balanced with the urging force of the tension spring 37, the paper feed roller 34 stops being displaced to convey the recording paper P. Accordingly, the large force generated the moment the paper feed roller 34 begins to rotate is lessened by the displacement of the paper feed roller 34 itself. The lessened force is then applied to the recording paper P as a conveyance force. Thus, a multi feed of the recording paper P can be prevented reliably.

Figure 9:
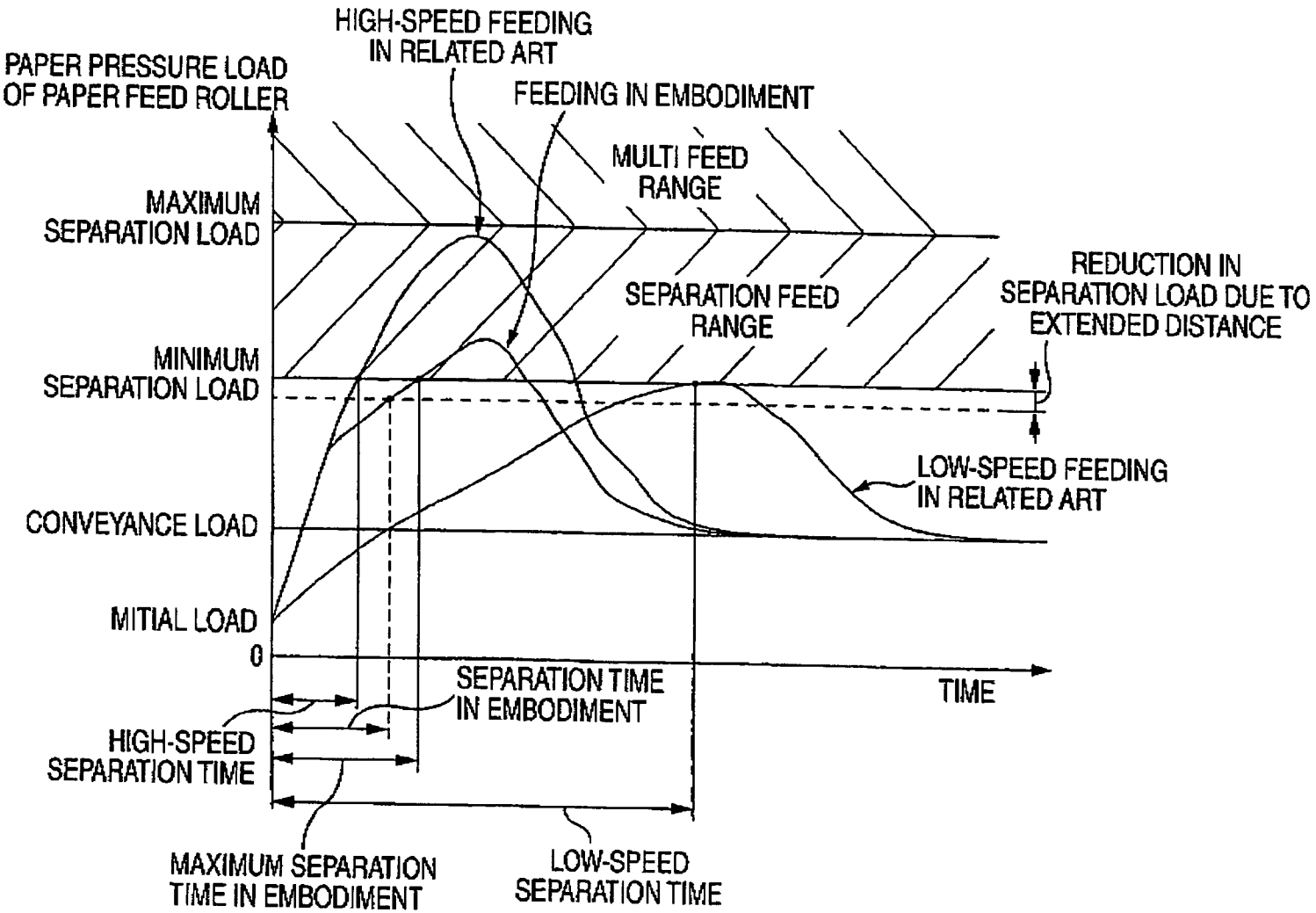
FIG. 9 is a graph showing the advantage of the paper feed roller unit.

This principle will be described more in detail with reference to the graph shown in FIG. 9. In the paper feed apparatus 10, the top sheet of the recording paper P cannot be separated from the lower sheets of the recording paper P unless a certain load (minimum separation load) is applied between the paper feed roller 34 and the recording paper P. On the contrary, when the load applied between the paper feed roller 34 and the recording paper P exceeds a certain load (maximum separation load) larger than the minimum separation load, a multi feed occurs.

On the other hand, the holder member 32 is urged clockwise by a not-shown torsion spring provided coaxially with the driving shaft 15. Accordingly, some load (initial load) is applied between the paper feed roller 34 and the recording paper P before the transmission of torque to the paper feed roller 34. Then, when the toque is transmitted to the paper feed roller 34, a clockwise moment in FIG. 5 acts on the paper feed roller unit 31. Thus, the load increases. When the load then exceeds the minimum separation load, the top sheet of the recording paper P is separated. After the load increases further, the load decreases with the conveyance of the recording paper P, and is settled in a conveyance load smaller than the minimum separation load.

In the related-art apparatus, the paper feed roller unit as a whole is formed as a rigid body. Therefore, the aforementioned change in load is comparatively simple. That is, high-speed paper feed in which the maximum load is set just under the maximum separation load or low-speed paper feed in which the maximum load is set just above the minimum separation load is selected. In this case, in the former, a multi feed occurs easily due to a change in quality of the recording paper P or the like. In the latter, the time for the top sheet of the recording paper P to be separated becomes long. Thus, the lowered conveyance rate goes against the trend to increase the speed of image formation.

In contrast, according to this embodiment, the paper feed roller unit 31 is designed to be able to bend as described above, so that the paper feed roller 34 can be displaced while rolling on the recording paper P. Accordingly, increase in load is moderated halfway so that the separation time can be shortened while preventing a multi feed. In addition, according to this embodiment, the aforementioned distance L (see FIG. 6) is extended due to the displacement of the paper feed roller 34. Accordingly, there is also a possibility that the minimum separation load is reduced so that the separation time can be further shortened, as shown by the broken line in FIG. 9.

In such a manner, in the paper feed roller unit 31 according to this embodiment, the conveyance speed of the recording paper P can be secured while reliably preventing a multi feed. In the paper feed roller unit 31, the swinging distance of the support member 33 is limited by the stopper portions 32*a* and 32*b*. Thus, the recording paper P can be conveyed more stably.

The invention has been described above along with its specific embodiment. However, the invention is not limited to the aforementioned embodiment at all. For example, the invention can be carried out in various embodiments without departing the gist of the invention as follows. The following embodiments will be described using a so-called bottom feed type paper feed apparatus in which a loading plate 11*a* serving as a tray is disposed horizontally, by way of example. However, needless to say, these embodiments can be also applied to inclined-feed type paper feed apparatus 10 in which a loading plate 11*a* serving as a tray is disposed with a slope as described previously.

Figure 10:
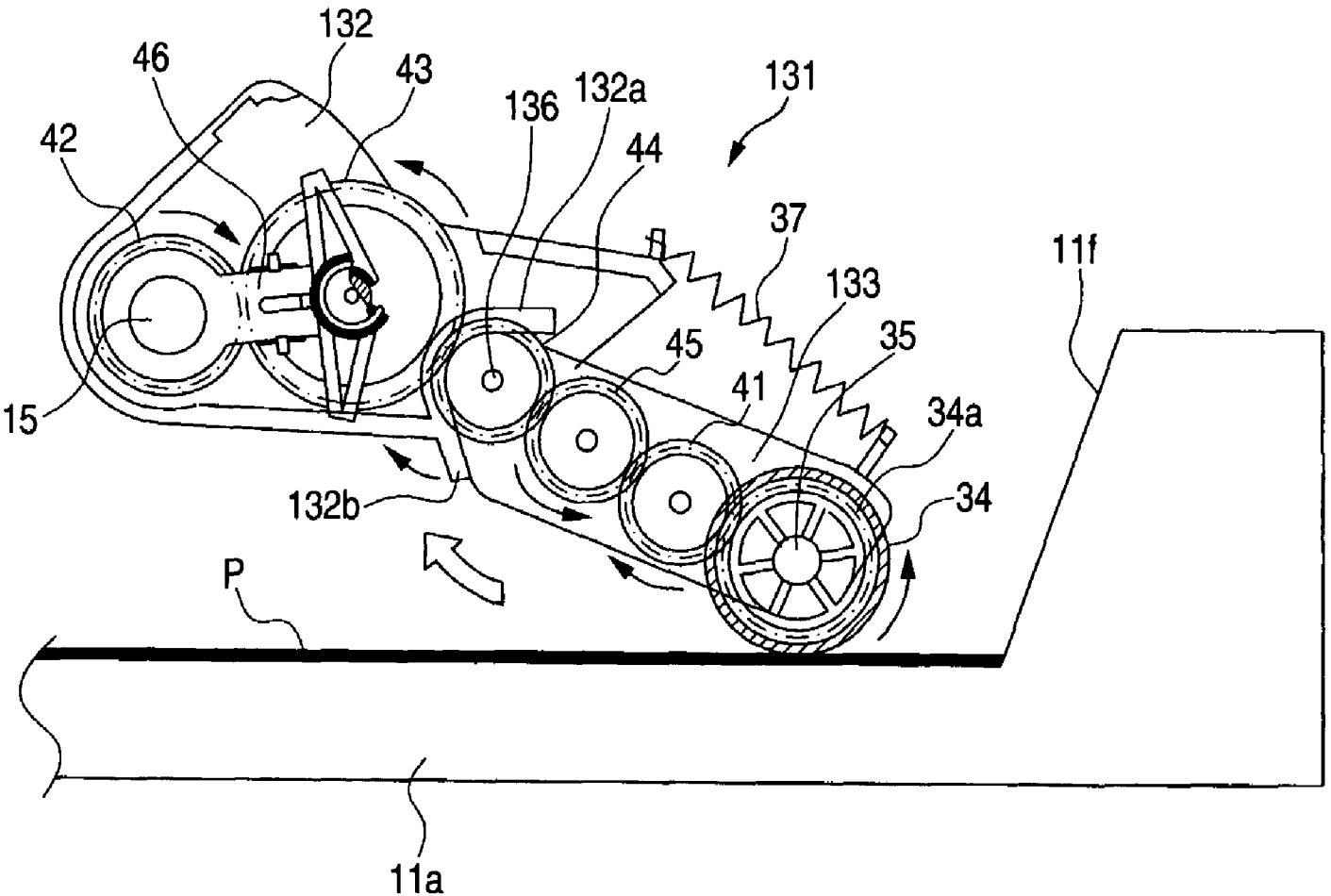
FIG. 10 is an explanatory view showing a modification of the paper feed roller unit.

In a paper feed roller unit 131 shown in FIG. 10, a swinging shaft 136 serves as the rotating shaft of the gear 44, and a support member 133 for supporting the configuration of the paper feed roller unit 131 on the front end side (paper feed roller 34 side) of the swinging shaft 136 is designed to swing around the swinging shaft 136. Also in this case, stopper portions 132*a* and 132*b* for limiting the swinging distance of the support member 133 are formed in a holder member 132 for supporting the driving shaft 15 and the swinging shaft 136.

In this case, the displacement of the rotating shaft 35 due to the bending of the paper feed roller unit 131 is larger than that in the aforementioned paper feed roller unit 31. Accordingly, the effect with which the load applied to the recording paper P is adjusted by the bending of the paper feed roller unit 131 and the displacement of the paper feed roller 34 is exerted more reliably according to this embodiment. On the contrary, when the support member 33 is shorter than the holder member 32 as in the paper feed roller unit 31, the aforementioned change in load generated by the bending of the paper feed roller unit 31 and the displacement of the paper feed roller 34 is so small that the adjustment becomes easy.

Figure 11:
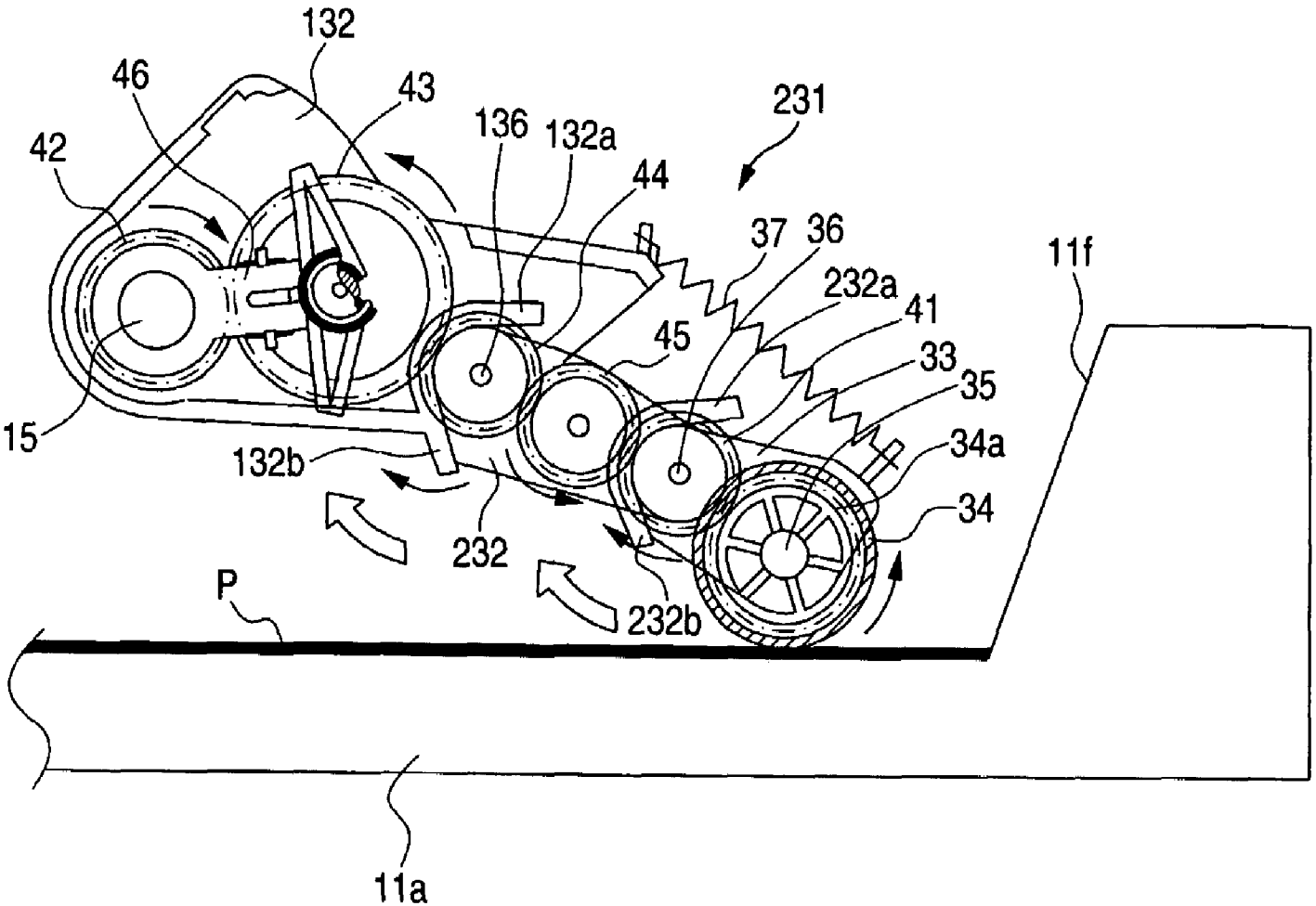
FIG. 11 is an explanatory view showing another modification of the paper feed roller unit.

Alternatively, as shown in FIG. 11, the holder member 132 and the swinging shaft 136 described above are used together with the support member 33 and the swinging shaft 36 similar to those in the paper feed roller unit 31, while the gears 44 and 45 are supported by a second support member 232 swingably connected between the swinging shafts 136 and 36. A paper feed roller unit 231 configured thus is bent in the two swinging shafts 136 and 36. Accordingly, various parameters can be adjusted by adjusting distances among the driving shaft 15, the swinging shaft 136, the swinging shaft 36 and the rotating shaft 35. Thus, fine setting can be achieved.

In the embodiment shown in FIG. 11, the tension spring 37 is disposed between the upper surface of the holder member 132 and the upper surface of the support member 33. However, tension springs may be disposed between the upper surface of the holder member 132 and the upper surface of the second support member 232 and between the upper surface of the second support member 232 and the upper surface of the support member 33 respectively. In this case, finer setting can be achieved by adjusting spring constants of the tension springs.

Figure 12:
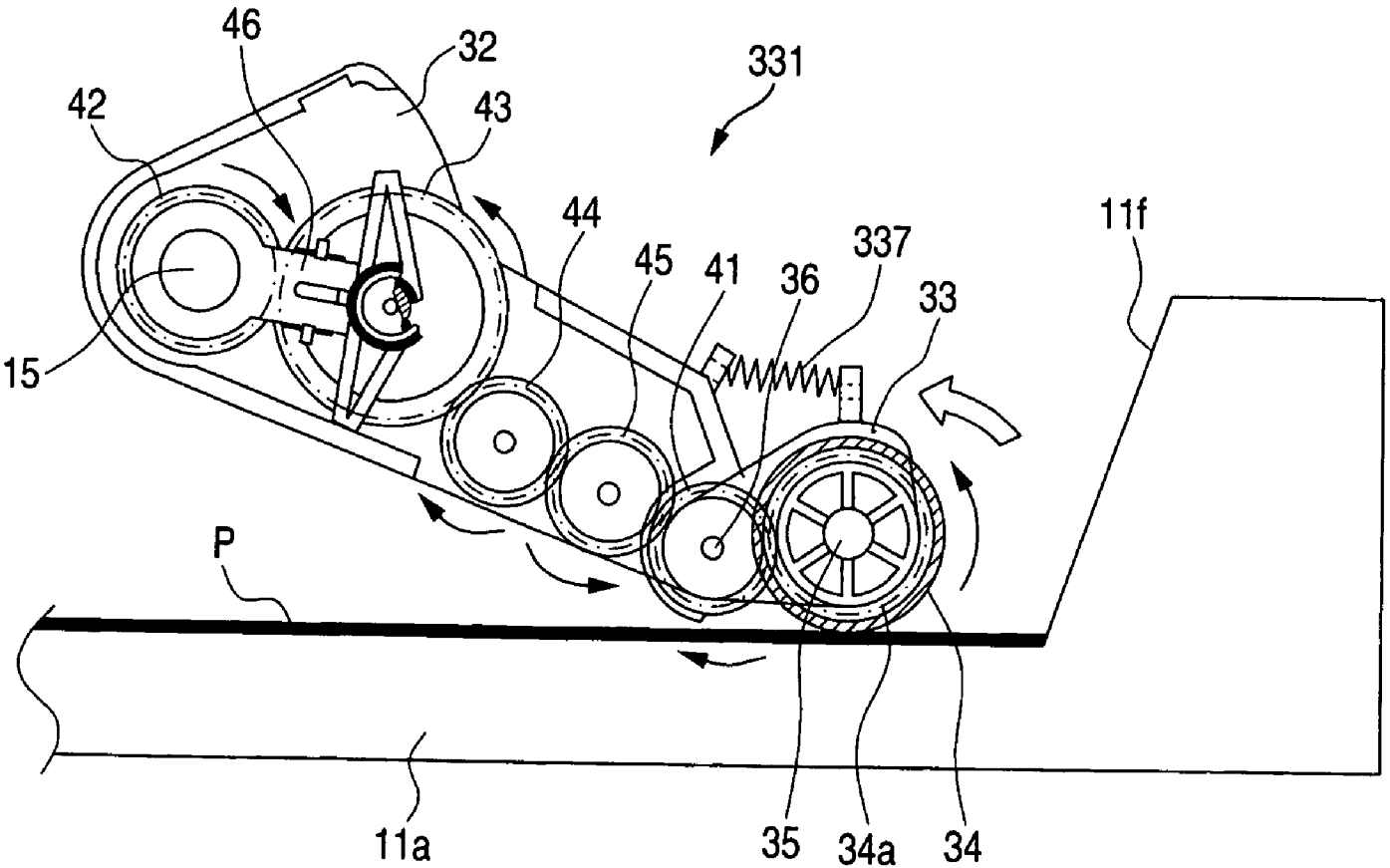
FIG. 12 is an explanatory view showing a further modification of the paper feed roller unit.

Moreover, in a configuration substantially similar to that of the paper feed roller unit 31, the configuration of the stopper portions 32*a* and 32*b*, etc. may be changed so that the holder member 32 and the support member 33 are bent to be upward convex toward the loading plate 11*a* as in a paper feed roller unit 331 shown in FIG. 12. In this case, a compression spring 337 is disposed between the upper surface of the holder member 32 and the upper surface of the support member 33. However, when the paper feed roller unit 331 is designed to be bent to be upward convex on the side where the paper feed roller unit 331 leaves the loading plate 11*a* as in the respective embodiments, it is possible to more reliably prevent the paper feed roller unit from abutting against the recording paper P.

Figure 13:
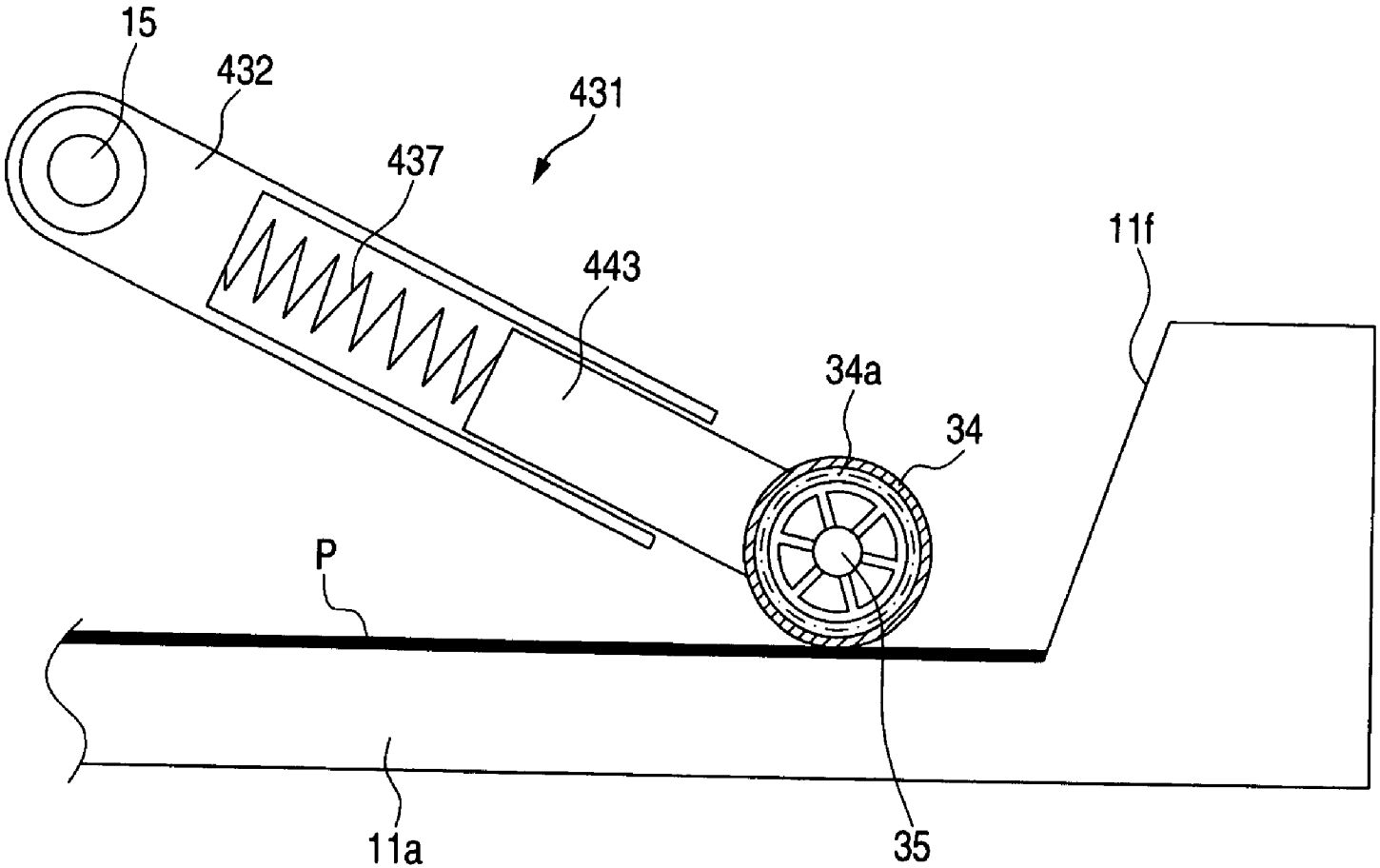
FIG. 13 is an explanatory view showing another embodiment of the paper feed roller unit.

As for the configuration with which the paper feed roller unit is extended/reduced, the following mode can be considered as well as the mode in which the paper feed roller unit is bent as in each of the aforementioned embodiments. In a paper feed roller unit 431 shown in FIG. 13, a holder member 432 is formed into a cylinder, and a support member 433 is formed into a piston to which the support member 433 is inserted. Thus, the distance between the driving shaft 15 and the rotating shaft 35 can be extended/reduced. A compression spring 437 is disposed between the bottom surface of a hollow portion of a holder member 432 and the end surface of the support member 433 on the driving shaft 15 side. Thus, an urging force is given in a direction to extend the distance between the driving shaft 15 and the rotating shaft 35.

The driving shaft 15 is located on the opposite side to the conveyance direction of the recording paper P in view from the rotating shaft 35. Accordingly, the urging force generated by the compression spring 437 acts to suppress the displacement of the paper feed roller 34 generated by the displacement of the paper feed roller 34. Various methods can be used for transmitting the driving force to the paper feed roller 34. Examples of the methods include a method using an extendable/contractable member such as a rubber belt, a method in which a universal joint is used as in the following embodiment. Even when such a configuration is used, advantages similar to those in each of the aforementioned embodiments are exerted. When the driving force is transmitted through the gears while the paper feed roller unit is contracted/extended by bending/extending in each of the aforementioned embodiments, the configuration can be further simplified.

Figure 14:
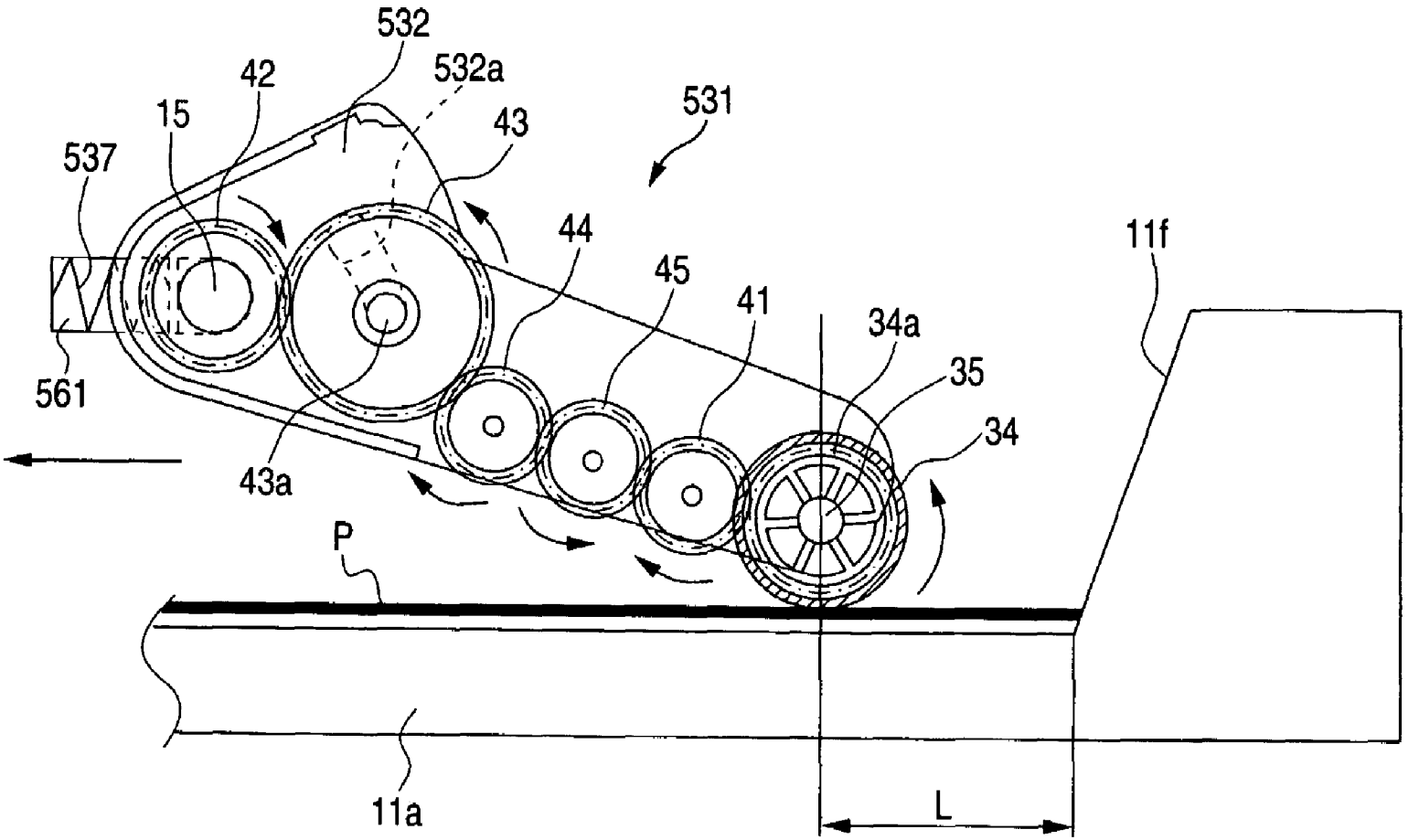
FIG. 14 is an explanatory view showing a further embodiment of the paper feed roller unit.

Alternatively, as in a paper feed roller unit 531 shown in FIG. 14, all the gears 41-45 and the paper feed roller 34 may be rotatably attached to an integrated holder member 532 provided so that the integrated holder member 532 as a whole can move in parallel along the surface of the loading plate 11*a*. The holder member 532 is urged toward the separation slope 11*f* by a compression spring 537 through the driving shaft 15. In addition, in the paper feed roller unit 531, the planet gear 43 is not supported by the arm 46, but an arcuate hole 532*a* concentric with the driving shaft 15 is provided in a side surface of the holder member 532, and the rotating shaft 43*a* of the planet gear 43 is fitted into the hole 532*a* so as to support the planet gear 43.

Also in this case, when the driving shaft 15 and the sun gear 42 rotate clockwise, the planet gear 43 also swings in the same direction so as to engage with the gear 44. Thus, the paper feed roller 34 can be rotated in the paper feed direction (counterclockwise) through the gears 44, 45, 41 and 34*a*.

Figure 15A:
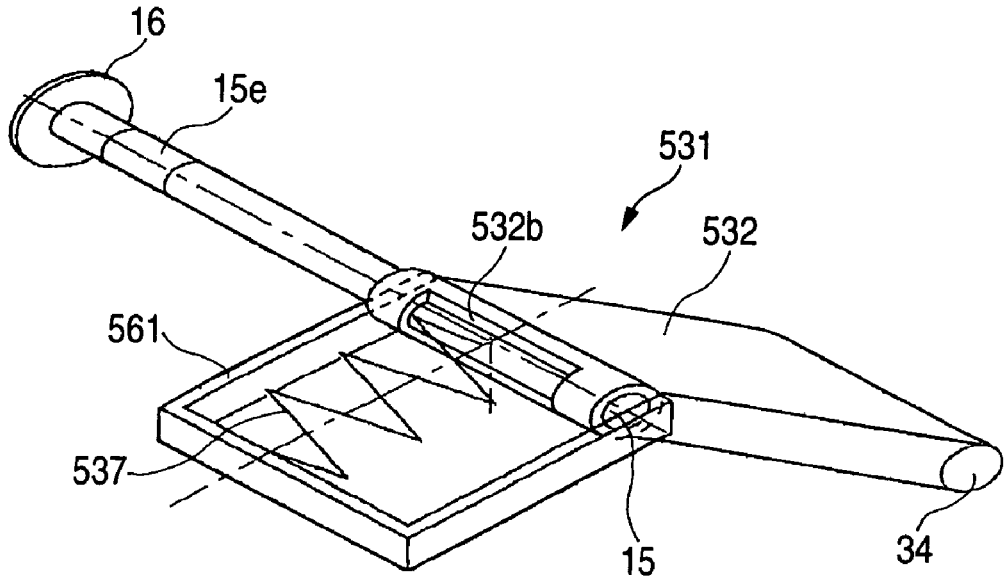
FIGS. 15A-15B are perspective views showing a drive mechanism of the paper feed roller unit shown in FIG. 14.
Figure 15B:
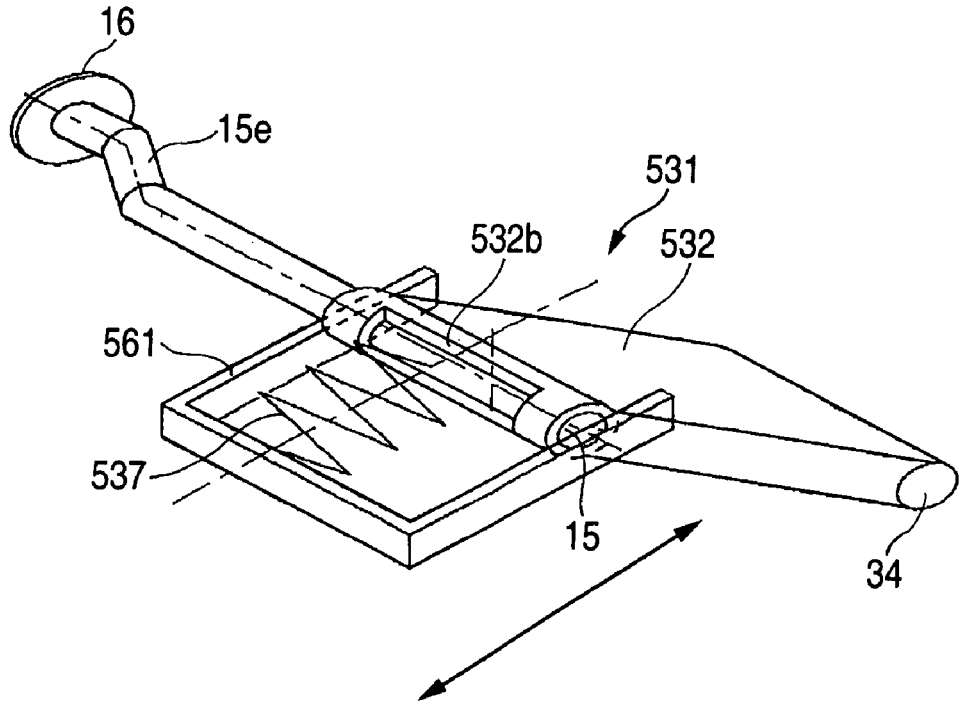

In addition, the opposite ends of the driving shaft 15 are supported movably in parallel as mentioned above, by the two opposite sides of a frame 561 having a U-shape in plan view as shown in FIGS. 15A-15B. A hole 532*b* is provided in the left end surface of the holder member 532 in FIG. 14. A compression spring 537 is disposed between the driving shaft 15 exposed from the hole 532*b* and the frame 561. Further, the driving shaft 15 in this embodiment is provided with a universal joint 15*e* between the driving shaft 15 and the aforementioned transmission unit 16. Due to the universal joint 15*e*, the driving shaft 15 can transmit toque even if the driving shaft 15 moves in parallel.

Also in the paper feed roller unit 531 configured thus, the paper feed roller 34 is displaced while rolling on the recording paper P till the urging force of the compression spring 537 is balanced against the force with which the paper feed roller 34 is to be displaced. Thus, advantages similar to those in each of the aforementioned embodiment are exerted. When the paper feed roller 34 is not driven, the universal joint 15*e* is aligned with the driving shaft 15 as shown in FIG. 15A. As the paper feed roller 34 is displaced as mentioned above, the universal joint 15*e* is deformed obliquely as shown in FIG. 15B.

Figure 16:
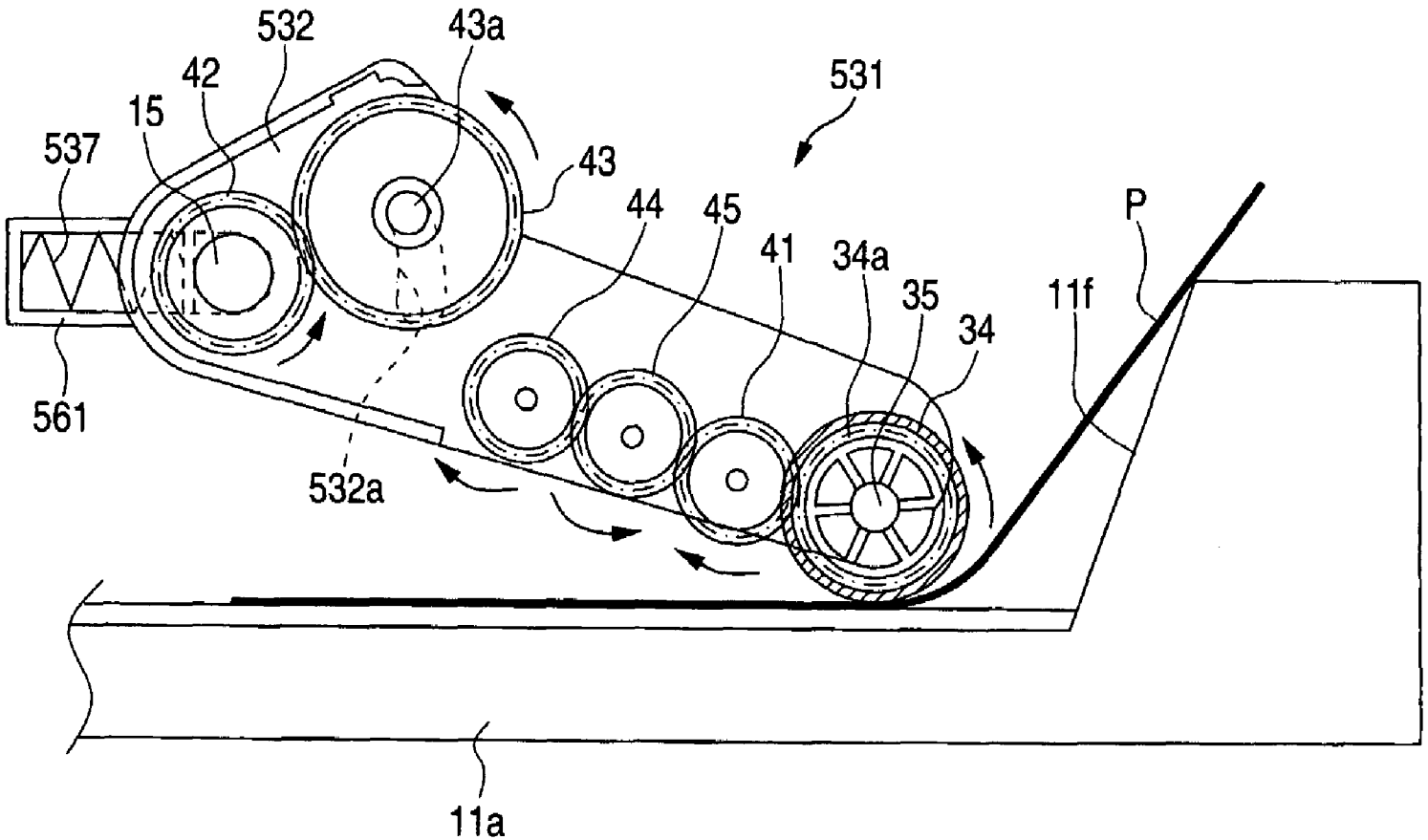
FIG. 16 is an explanatory view showing the operation of the paper feed roller unit shown in FIG. 14.

According to this embodiment, when the driving shaft 15 and the sun gear 42 rotate counterclockwise, the planet gear 43 also swings in the same direction along the hole 532*a*. Thus, engagement with the gear 44 is released. As a result, as shown in FIG. 16, the mechanisms ranging from the gear 44 to the paper feed roller 34 can rotate freely so that the paper feed roller 34 is rotated as the recording paper P is conveyed.

In such a manner, in the paper feed roller unit 531, the planet gear 43 is supported by the hole 532*a* provided in the holder member 532. Accordingly, the number of parts can be reduced and the manufacturing cost can be reduced in comparison with that when the arm 46 etc. are used. Instead of the hole 532*a*, a groove having a similar surface shape as the hole 532*a* may be formed in the inner wall surface of the holder member 532. Also in this case, similar advantages are exerted.

Further, the invention is not limited to application to printer paper feed apparatus according to the aforementioned embodiments. The invention can be applied to various apparatus if they serve to convey sheets retained in a stacked state.

In the aforementioned embodiments, each paper feed roller unit 31, 131, 231, 331, 431, 531 corresponds to a paper feed roller unit, each holder member 32, 132, 432 with each support member 33, 133, 232, 433 or the holder member 532 corresponds to a holder unit, each stopper portion 32*a*, 32*b*, 132*a*, 132*b* corresponds to a regulation unit, the paper feed roller 34 corresponds to a feed roller, the tension spring 37 or each compression spring 337, 437, 537 corresponds to an urging unit, the universal joint 15*e*, the driving shaft 15, the transmission unit 16, the gears 34*a*, 41, 44 and 45, the sun gear 42 and the planet gear 43 correspond to a driving force transmission unit, the cork pad 51 corresponds to a frictional separation material, the lock lever 52 corresponds to a stopper, and the recording paper P corresponds to a sheet.

Further, of the aforementioned driving force transmission unit, the sun gear 42 corresponds to a sun gear, the planet gear 43 corresponds to a planet gear, the gear 41 in FIG. 5-8, 11 or 12 and the gear 44 in FIG. 10 or 11 correspond to a first gear, the gear 45 in FIG. 5-8, 11 or 12 and the planet gear 43 in FIG. 10 or 11 correspond to a second gear, the gear 34*a* in FIG. 5-8, 11 or 12 and the gear 45 in FIG. 10 or 11 correspond to a third gear.

As described above with reference to the embodiment, according to one aspect, there is provided a feed roller unit including: a feed roller that abuts against a topmost sheet of a stack of sheets, and rotates to convey the topmost sheet in a conveyance direction, the feed roller being provided to be displaceable in a direction reverse to the conveyance direction while rolling on the topmost sheet; a driving force transmission unit that transmits a driving force generated by a driving source to the feed roller to rotate the feed roller; and an urging unit that provides an urging force to the feed roller in a direction to suppress the displacement of the feed roller.

According to the configuration, the feed roller can be displaced while rolling on the top sheet in a direction reverse to the conveyance direction thereof with the rotation of the feed roller. On the other hand, the urging unit gives an urging force to the feed roller in a direction to suppress the displacement of the feed roller. Accordingly, the moment the feed roller begins to rotate, the feed roller is displaced while rolling on the sheet. As soon as the force with which the feed roller is to be displaced is balanced with the urging force of the urging unit, the feed roller stops the displacement and conveys the sheet. That is, according to the invention, the large force that is generated the moment the feed roller begins to rotate is lessened by the displacement of the paper feed roller itself. The lessened force is then applied to the sheet. Thus, a multi feed of the sheets can be prevented reliably.

The roller unit is not limited to having an arm for supporting the feed roller as disclosed in the related art. However, the roller unit may further include a driving shaft disposed in a position above the sheets retained in a stacked state and at a distance from a rotating shaft of the feed roller in a direction reverse to the conveyance direction and in parallel to the rotating shaft. In this case, another advantage is exerted as follows.

That is, in this case, the driving shaft is located in the aforementioned position. Accordingly, the moment to press the feed roller against the sheet acts on the holder unit due to the rotation of the feed roller. Thus, the sheet can be conveyed more reliably while applying a moderate pressing force to the sheet. Further, since the driving shaft is disposed in parallel to the rotating shaft of the feed roller, the feed roller can abut against the sheet moderately regardless of the swinging of the holding member.

In the case where this configuration is used, the driving shaft may be designed to be displaced along an upper surface of the sheets retained in a stacked state, while the urging unit urges the driving shaft in the conveyance direction. In this case, the urging force provided by the urging unit is transmitted to the rotating shaft of the feed roller through the driving shaft and the holder unit in turn, so as to suppress the displacement of the feed roller.

Alternatively, the holder unit may be designed to be able to extend/reduce a distance between the driving shaft and the rotating shaft, while the urging unit provides an urging force in a direction to extend the distance between the driving shaft and the rotating shaft. As described previously, the driving shaft is disposed in a position at a distance from the rotating shaft of the feed roller in a direction reverse to the conveyance direction. Accordingly, in this case, the urging force provided by the urging unit to extend the holder unit acts in a direction to suppress the displacement of the feed roller.

When the holder unit is designed to be able to extend/contract thus, the holder unit may be designed to be able to bend around one or more swinging shafts parallel to the rotating shaft and the driving shaft, while the distance between the driving shaft and the rotating shaft is extended/contracted due to bending or expansion of the holder unit. In this case, the configuration for extending/contracting the holder unit can be extremely simplified. Further, since the swinging shaft is parallel to the rotating shaft and the driving shaft, the feed roller can abut against the sheet moderately regardless of the extension/contraction of the holder unit.

In the case where this configuration is used, the driving force transmission unit may further include a first gear rotating around each of the swinging shafts, a second gear engaging with the first gear so as to transmit the driving force generated by the driving source to the first gear, and a third gear engaging with the first gear so as to transmit the driving force transmitted to the first gear toward the feed roller. In this case, the driving force generated by the driving source is transmitted to the feed roller through the second gear, the first gear and the third gear in turn. In addition, the first gear rotates around the swinging shaft so that the driving force can be transmitted moderately regardless of the bending of the holder unit. Further, when the first gear rotates while engaging with the first and third gears, the force to bend the holder unit can be made to act thereon. Accordingly, when the gear ratio or the like among the gears is set suitably, the speed with which the rotating shaft of the feed roller moves due to the bending of the holder unit can be made equal to the speed with which the feed roller is displaced while rolling on the sheet. Thus, the frictional force applied to the sheet can be reduced.

When the holder unit is designed to be able to bend as described above, the feed roller unit may further includes a regulation unit for regulating a bending amount of the holder unit. In this case, once the holder unit bends by a predetermined quantity, the holder unit no longer bends. Thus, the sheet can be conveyed more stably.

Further, when the holder unit is designed to be able to bend as described above, the number of the swinging shafts may be one, while a distance between the swinging shaft and the rotating shaft is longer than a distance between the swinging shaft and the driving shaft. In this case, a further advantage is exerted as follows. That is, the displacement of the rotating shaft of the feed roller due to the bending of the holder unit is large. Accordingly, the advantage of adjusting the conveyance force applied on the sheet due to the bending of the holder unit and the displacement of the feed roller is exerted more reliably.

On the contrary, the number of the swinging shafts may be one, while a distance between the swinging shaft and the rotating shaft is shorter than a distance between the swinging shaft and the driving shaft. In this case, the displacement of the rotating shaft of the feed roller due to the bending of the holder unit is small. Thus, adjustment becomes easy.

Further, when the holder unit is designed to be able to bend as described above, the holder unit maybe bent to be convex upward. In this case, a further advantage is exerted as follows. That is, even when the holder unit is bent, a portion of the holder unit near the swinging shaft moves in a direction to leave the surface of the sheet. Accordingly, the portion of the holder unit near the swinging shaft can be reliably prevented from abutting against the sheet.

Further, when the holder unit is designed to be able to bend as described above, the number of the swinging shafts provided in the holder may be plural. In this case, a further advantage is exerted as follows. That is, by adjusting the distances among the swinging shafts, various parameters can be adjusted so that fine setting can be done.

When the holder unit is provided as described above, the driving force transmission unit may include a sun gear supported rotatably on the holder unit and rotating due to the driving force generated by the driving source and transmitted to the sun gear, and a planet gear always engaging with the sun gear so as to be able to swing around the sun gear with rotation of the sun gear, wherein the planet gear transmits the driving force toward the feed roller when the sun gear rotates in a predetermined direction so as to allow the planet gear to swing in the predetermined direction, and the planet gear transmits no driving force toward the feed roller when the sun gear rotates in a direction reverse to the predetermined direction so as to allow the planet gear to swing in the reverse direction. In this case, the mode in which the driving force for conveying the sheet is transmitted to the feed roller and the mode in which the transmission path of the driving force ranging from the driving source to the feed roller is blocked halfway can be switched by the rotating direction of the sun gear. In the case where the mode is switched to the latter mode, the feed roller can be rotated freely when the sheet is conveyed by another conveyance unit.

In this case, the holder unit may include a groove or hole formed to be arcuate and concentric with a rotation center of the sun gear, while a rotating shaft of the planet gear moves in the groove or hole. The planet gear is typically supported rotatably by an arm-like support member swinging concentrically with the sun gear. In this case, a similar advantage can be obtained when the planet gear is supported by the groove or hole formed in the holder unit. Thus, the number of parts can be reduced so that the manufacturing cost can be reduced.

According to another aspect, there is provided a conveyance apparatus including a tray for retaining the sheets in a stacked state, and a feed roller unit according to any one of the aforementioned configurations. Accordingly, in the conveyance apparatus according to the invention, application of a large conveyance force to the sheets the moment the feed roller begins to rotate is suppressed so that a multi feed of the sheets can be prevented reliably.

Further, in this conveyance apparatus, a separation slope may be formed on a downstream side of the tray in the conveyance direction. The separation slope separates the sheets one by one when leading edges of the sheets are pressed onto the separation slope. In this case, further advantage is exerted as follows. In the conveyance apparatus configured thus, the top sheet is bent between the feed roller and the separation slope so that the sheets are separated and conveyed one by one. Accordingly, it is preferable that the distance between the feed roller and the separation slope is wider as the sheets are firmer. According to the invention, the distance with which the feed roller is displaced is increased as the sheets are firmer. Thus, the distance between the feed roller and the separation slope can be adjusted to an optimum value without using any sensor or the like.

Moreover, the conveyance apparatus according to the invention may further include: a friction separation member provided in a position opposed to the feed roller in an upper surface of the tray and for giving a frictional force to a bottommost the sheets to thereby separate the sheets in cooperation with the feed roller; and a stopper always urged to project from the friction separation member so that the stopper projects over the friction separation member to thereby prevent the feed roller and the friction separation member from coming in contact with each other again as soon as there is no sheets on the friction separation member and further the feed roller is displaced on the friction separation member and leaves the friction separation member.

In this configuration the stopper is urged to project from the friction separation member to prevent the feed roller and the friction separation member from coming in contact with each other when the bottommost sheet is conveyed by the feed roller and the feed roller is displaced in the reverse direction to roll out from the bottommost sheet.

In this case, when there are sheets on the friction separation member, the friction separation member gives a frictional force to the bottom sheet so as to help the feed roller separate the sheets. When there is no sheet on the friction separation member, the feed roller comes in direct contact with the friction separation member. Thus, the feed roller is displaced on the friction separation member and leaves the friction separation member. Then, the stopper projects over the friction separation member so as to prevent the feed roller from abutting against the friction separation member again.

The tray surface is generally smoother to slide thereon than the friction separation member or the sheet. Without the stopper, the feed roller displaced on the friction separation member and reaching the tray surface would be pushed back by the urging unit and abut against the friction separation member again. When the feed roller abuts against the friction separation member repeatedly many times in such a manner, periodic noise might be generated, and further both the feed roller and the friction separation member might be worn down. Therefore, the stopper is provided as described above. Thus, the noise is prevented from being generated, and the feed roller and the friction separation member can be prevented from being worn down.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application program to enable one skilled in the art to utilize the invention in various embodiments and with various modifications as are suited to the particular use contemplated. It is intended that the scope of the invention be defined by the claims appended hereto, and their equivalents.

What is claimed is:

1. A feed roller unit comprising:

a feed roller that abuts against a topmost sheet of a stack of sheets, and rotates to convey the topmost sheet in a conveyance direction, the feed roller being provided to be displaceable in a direction reverse to the conveyance direction while rolling on the topmost sheet;

a driving force transmission unit that transmits a driving force generated by a driving source to the feed roller via a driving shaft to rotate the feed roller;

an urging unit that provides an urging force to the feed roller in a direction to suppress the displacement of the feed roller; and a holder unit that swings, at one end thereof, around the driving shaft and supports, at the other end thereof, a rotating shaft of the feed roller, wherein the driving force transmission unit includes a switching mechanism disposed in the holder unit and between the driving shaft and the feed roller, the switching mechanism connecting and disconnecting the transmission of the driving force from the driving shaft to the feed roller.

2. The feed roller unit according to claim 1, wherein the driving shaft is disposed in a position above the stack of sheets, at a distance from the rotating shaft of the feed roller in the direction reverse to the conveyance direction, and in parallel to the rotating shaft.

3. A feed roller comprising:

a feed roller that abuts against a topmost sheet of a stack of sheets, and rotates to convey the topmost sheet in a conveyance direction, the feed roller being provided to be displaceable in a direction reverse to the conveyance direction while rolling on the topmost sheet;

a driving force transmission unit that transmits a driving force generated by a driving source to the feed roller via a driving shaft to rotate the feed roller;

an urging unit that provides an urging force to the feed roller in a direction to suppress the displacement of the feed roller; and a holder unit that swings, at one end thereof, around the driving shaft and supports, at the other end thereof, a rotating shaft of the feed roller, wherein the driving forces transmission unit includes a switching mechanism disposed in the holder unit and between the driving shaft and the feed roller, the switching mechanism connecting and disconnecting the transmission of the driving force from the driving shaft to the feed roller, wherein the driving shaft is configured to be displaceable along an upper surface of the stack of sheets, and wherein the urging unit urges the driving shaft in the conveyance direction.

4. The feed roller unit according to claim 2, wherein the holder unit is configured to extend and reduce a distance between the driving shaft and the rotating shaft, and wherein the urging unit provides the urging force in a direction to extend the distance between the driving shaft and the rotating shaft.

5. The feed roller unit according to claim 4, wherein the holding unit is configured to be bent around at least one swinging shaft that is provided to be parallel to the rotating shaft and the driving shaft, and the distance between the driving shaft and the rotating shaft is extended and reduced due to the bending and extension of the holding unit.

6. The feed roller unit according to claim 5, wherein the driving force transmission unit includes:

a first gear that rotates around the swinging shaft;

a second gear that engages with the first gear and transmit the driving force generated by the driving source to the first gear; and a third gear that engages with the first gear and transmits the driving force transmitted to the first gear to the feed roller.

7. The feed roller unit according to claim 5, further comprising a regulation unit that regulates a bending amount of the holding unit.

8. The feed roller unit according to claim 5, wherein a single swinging shaft is provided in the holding unit, and wherein a distance between the swinging shaft and the rotating shaft is longer than a distance between the swinging shaft and the driving shaft.

9. The feed roller unit according to claim 5, wherein a single swinging shaft is provided in the holding unit, and wherein a distance between the swinging shaft and the rotating shaft is shorter than a distance between the swinging shaft and the driving shaft.

10. The feed roller unit according to claim 5 wherein the holding unit is bent to be convex toward a direction away from the stack of sheets.

11. The feed roller unit according to claim 5, wherein a plurality of swinging shafts is provided in the holding unit.

12. The feed roller unit according to claim 1, wherein the switching mechanism includes:

a sun gear supported on the driving shaft and rotating due to the driving force generated by the driving source and transmitted to the driving shaft; and a planet gear that engages with the sun gear to swing around the sun gear with the rotation of the sun gear, wherein the planet gear transmits the driving force to the feed roller when the sun gear rotates in a predetermined direction so as to allow the planet gear to swing in the predetermined direction, and wherein the planet gear transmits no driving force to the feed roller when the sun gear rotates in a direction reverse to the predetermined direction so as to allow the planet gear to swing in the reverse direction.

13. The feed roller unit according to claim 12, wherein the holding unit includes at least one of a groove and a hole formed to be arcuate and concentric with a rotation center of the sun gear, and in which a rotating shaft of the planet gear moves.

14. A conveyance apparatus comprising:

a tray that retains a stack of sheets;

a feed roller that abuts against a topmost sheet of the stack of sheets in the tray, and rotates to convey the topmost sheet in a conveyance direction, the feed roller being provided to be displaceable in a direction reverse to the conveyance direction while rolling on the topmost sheet;

a driving force transmission unit that transmits a driving force generated by a driving source to the feed roller via a driving shaft to rotate the feed roller; and an urging unit that provides an urging force to the feed roller in a direction to suppress the displacement of the feed roller; and a holder unit that swings, at one end thereof, around the driving shaft and supports, at the other end thereof, a rotating shaft of the feed roller, wherein the driving force transmission unit includes a switching mechanism disposed in the holder unit and between the driving shaft and the feed roller, the switching mechanism connecting and disconnecting the transmission of the driving force from the driving shaft to the feed roller.

15. The conveyance apparatus according to claim 14, further comprising a separation slope being formed on a downstream side of the tray in the conveyance direction, the separation slope separating the sheets when leading edges of the sheets are pressed thereon.

16. The conveyance apparatus according to claim 14, further comprising:

a friction separation member provided in an upper surface of the tray in a position opposed to the feed roller, the friction separation member applying a frictional force to a bottommost sheet of the stack of sheets to separate the sheets in cooperation with the feed roller; and a stopper being urged to project from the friction separation member to prevent the feed roller and the friction separation member from coming in contact with each other when the bottommost sheet is conveyed by the feed roller and the feed roller is displaced in the reverse direction to pass over the friction separation member.

17. The feed roller unit according to claim 1, wherein the switching mechanism comprises a plant gear mechanism that connects the transmission of the driving force from the driving shaft to the feed roller when the driving shaft is rotated by the driving force in a first direction, and that disconnects the transmission of the driving force from the driving shaft to the feed roller when the driving shaft is rotated by the driving force in a second direction opposite to the first direction.

18. The feed roller unit according to claim 17, wherein the driving force transmitted by the plant gear mechanism acts on the feed roller to rotate (1) to displace the feed roller in the direction reverse to the conveyance direction and (2) to convey the topmost sheet in the conveyance direction.

19. The feed roller unit according to claim 18, wherein when the planet gear mechanism disconnects the transmission of the driving force from the driving shaft to the feed roller, the feed roller is rotated freely and displaced in the conveyance direction, while contacting the topmost sheet.

20. The feed roller unit according to claim 19, wherein:

the driving force transmission unit includes a gear mechanism having the planet gear mechanism and an input gear to which the driving force is selectively transmitted from the planet gear mechanism;

the planet gear mechanism includes a sun gear to which the driving force is transmitted from the driving shaft, a planet gear engaging with the sun gear, and an arm supporting the planet gear to swing around the sun gear, while keeping the planet gear engaged with the sun gear;

when the driving shaft is rotated by the driving force in the first direction, rotation of the sun gear causes the planet gear to swing around the sun gear to engage with the input gear to transmit the driving force to the feed roller; and when the driving shaft is rotated by the driving force in the second direction, reverse rotation of the sun gear causes the planet gear to disengage from the input gear to interrupt the driving force to the feed roller.

* * * * *